US010420426B2

(12) United States Patent
Resch

(10) Patent No.: US 10,420,426 B2
(45) Date of Patent: Sep. 24, 2019

(54) REFRIGERATED DISPLAY CASE

(71) Applicant: AHT Cooling Systems GmbH, Rottenmann (AT)

(72) Inventor: Reinhold Resch, St. Peter (AT)

(73) Assignee: AHT Cooling Systems GmbH, Rottenmann (AT)

( * ) Notice: Subject to any disclaimer, the term of this patent is extended or adjusted under 35 U.S.C. 154(b) by 4 days.

(21) Appl. No.: 15/117,882

(22) PCT Filed: Feb. 4, 2015

(86) PCT No.: PCT/EP2015/052297

§ 371 (c)(1),
(2) Date: Aug. 10, 2016

(87) PCT Pub. No.: WO2015/121125

PCT Pub. Date: Aug. 20, 2015

(65) Prior Publication Data

US 2017/0007039 A1 Jan. 12, 2017

(30) Foreign Application Priority Data

Feb. 14, 2014 (DE) ..... 20 2014 100 662 U

(51) Int. Cl.
*A47F 3/04* (2006.01)
*A47F 5/10* (2006.01)

(52) U.S. Cl.
CPC ..... *A47F 3/0469* (2013.01); *A47F 3/0443* (2013.01); *A47F 3/0447* (2013.01); *A47F 5/10* (2013.01)

(58) Field of Classification Search
CPC .... A47F 3/0469; A47F 3/0443; A47F 3/0447; A47F 5/10
(Continued)

(56) References Cited

U.S. PATENT DOCUMENTS 2,284,898 A * 6/1942 Hartman ..... E04B 1/19 52/376
2,725,667 A * 12/1955 Ingarra ..... A47B 91/024 16/19
(Continued)

FOREIGN PATENT DOCUMENTS

DE 202006007152 U1 9/2006
JP H11276315 10/1999
(Continued)

*Primary Examiner* — Daniel J Troy
*Assistant Examiner* — Timothy M Ayres
(74) *Attorney, Agent, or Firm* — Jansson Munger McKinley & Kirby Ltd.

(57) ABSTRACT

A refrigerated display case comprising framework having four sides, each side including a C-shaped frame with a rear vertical side strut, a top side strut, and a bottom side strut; the C-shaped side frames are constructed separately and support cover panels of a bottom assembly, a rear wall assembly, and a top assembly, the cover panels being fastened by mounting elements and delimit a cooling chamber, the cooling chamber including at least one C-shaped intermediate frame between the C-shaped side frames, the at least one C-shaped intermediate frame is spaced laterally apart from the C-shaped side frames, the C-shaped intermediate frames each include a horizontal bottom intermediate strut, a vertical intermediate strut and a top intermediate strut.

10 Claims, 20 Drawing Sheets

(58) Field of Classification Search
USPC ..... 312/116
See application file for complete search history.

(56) References Cited

U.S. PATENT DOCUMENTS 2,843,231 A * 7/1958 Maruhn ..... B62D 21/02 280/800
2,901,301 A * 8/1959 Johnson ..... A47B 13/021 108/156
4,103,981 A * 8/1978 Donahue ..... A47B 17/003 108/159.11
4,435,940 A * 3/1984 Davenport ..... E04B 7/022 52/639
4,632,473 A * 12/1986 Smith ..... A47B 47/03 312/265.1
4,635,882 A * 1/1987 SenGupta ..... B64C 1/06 188/378
4,650,085 A * 3/1987 Davies ..... H02B 1/30 220/4.02
4,991,805 A * 2/1991 Solak ..... F16M 7/00 248/188.4
5,165,349 A * 11/1992 McAllister ..... A47B 13/021 108/156
5,372,262 A * 12/1994 Benson ..... A47B 47/02 211/189
5,517,826 A * 5/1996 Duffy ..... A47F 3/0443 312/116
9,265,360 B2 * 2/2016 Joseph ..... A47B 96/1458
2005/0066862 A1 * 3/2005 Choi ..... A47B 3/06 108/155
2010/0313588 A1 12/2010 Swofford
2014/0049033 A1 * 2/2014 Yee ..... B62D 21/09 280/797
2015/0230627 A1 * 8/2015 Resch ..... A47F 3/0443 62/255
2016/0345752 A1 * 12/2016 Resch ..... A47F 3/0443
2016/0353906 A1 * 12/2016 Rescho ..... A47F 3/0443

FOREIGN PATENT DOCUMENTS

WO 2011074993 A1 6/2011
WO 2011074994 A1 6/2011
WO 2014029613 A1 2/2014

* cited by examiner

REFRIGERATED DISPLAY CASE

CROSS-REFERENCE TO RELATED APPLICATION

The present application is a U.S. national phase entry of pending International Patent Application No. PCT/EP2015/052297, international filing date Feb. 14, 2015, which claims priority to German Patent Application No. DE 20 2014 100 662.1, filed Feb. 14, 2014, the contents of which are incorporated by reference in their entireties.

FIELD OF THE INVENTION

The device relates to a refrigerated display case and more particularly to a refrigerated display case with framework having at four sides, each side including a C-shaped frame with a rear vertical side strut, a top side strut, and a bottom side strut.

BACKGROUND OF THE INVENTION

A refrigerated display case of this kind is disclosed in DE 20 2006 007 152 U1. In this known refrigerated display case, there are two side stand modules, which are embodied in a C-shape composed of two vertical stand profiles with a U-shaped cross-section and upper and lower crossbeams affixed thereto by welding. The lower crossbeam is inserted into a pan-like bottom module and can be screw-mounted there during the installation. For this purpose, the bottom pan, which also contains a heat exchanger and a fan assembly, must have a correspondingly stable construction that is suitable for the installation of the stand module, which entails a relevant amount of work.

WO 2011/074994 A1 and WO 2011/074993 A1 disclose refrigerated display cases with a C-shaped cross-section and with bottom cover panels, rear wall cover panels, and top cover panels between which an air curtain is produced. The cover panels together with the side walls form a body of the unit, which rests on the floor by means of feet.

In general, such refrigerated display cases have a C-shaped cross-section, in which it is difficult to meet the requirements of a stable construction with the simplest possible mounting of the cover panels and cooling components while simultaneously taking into account a cooling chamber that can be used efficiently.

In the applicant's previously unpublished PCT/EP2013/066456, in a significant contrast with the previously known construction of refrigerated display cases, a modularly constructed refrigerated display case arrangement is disclosed in which each module has two C-shaped side frames, each having a vertical profile and a forward-protruding lower horizontal profile and an upper horizontal profile respectively mounted thereto. The lower horizontal profiles are provided with feet that rest on the floor, while cover panels with thermally insulating plate-shaped elements are mounted to the inside of the side frames oriented toward the cooling chamber. This design of the refrigerated display case provides a stable construction with a good thermally insulating encapsulation at the back as well as at the top and bottom; in order to increase stability, support profiles are installed between the lower and upper horizontal profiles, spaced apart from the rear vertical profiles and with the interposition of thermally insulating elements. This basic construction, with C-frames that are capable of bearing a load to which the cover panels are mounted and on which thermal components of the rear wall assembly, the top assembly, and the bottom assembly are supported, already offers significant advantages with regard to the construction and function of the refrigerated display case as compared to the previously existing prior art.

Objects of the Invention

The object of the present invention is to create a refrigerated display case of the type mentioned at the beginning, which improves the installation possibilities and assembly method.

SUMMARY OF THE INVENTION

The objects of the invention are attained through the features of claim 1. In this claim, between the C-shaped side frames, at least one C-shaped intermediate frame is provided, which is spaced laterally apart from them and is embodied differently from them, with a horizontal bottom intermediate strut, another vertical intermediate strut, and a top intermediate strut. The C-shaped side frames, which already have a high carrying capacity and rest on the floor by means of their bottom struts equipped with feet, together with the C-shaped intermediate frames, which are in turn supported on the floor by means of their bottom intermediate struts with feet, achieve an increased stability of the refrigerated display case that is provided with the cover panels. The C-shaped intermediate frames, which are embodied differently from the C-shaped side frames, achieve advantageously adaptable installation options with a simple mounting method. This also contributes to efficient embodiment options for the cooling function and utilization by the user. The side frames and the intermediate frames are preferably composed of metal, in particular of steel profiles. The side frames and the intermediate frames are units that are separate from the cover panels, i.e. they are not composed of the latter, but rather support them.

Advantageous mounting options for attaching the cover panels and/or the components of the cooling device are achieved by the fact that the at least one top intermediate strut and/or the top side strut has/have a hat-shaped cross-section. Other advantages for the mounting are achieved in that the cavity of the top intermediate struts is open toward the bottom and the cavity of the top side struts is open toward the top.

Other advantages for the construction and mounting are achieved in that the at least one vertical intermediate strut and/or the vertical side struts has/have a hat-shaped cross-section. Contributions to advantageous installation and mounting options are also made by the feature that the at least one bottom intermediate strut has a hat-shaped cross-section.

The construction is further benefitted by the fact that the bottom side struts are embodied in the form of a closed hollow profile with a square or rectangular cross-section or has a C-shaped or likewise hat-shaped cross-section.

Other advantages for the assembly are achieved by virtue of the fact that the vertical side struts are clamped against the rear ends of the top side struts and bottom side struts, with or without an intermediate piece, and the vertical intermediate struts are clamped against the rear ends of the (associated) top intermediate struts and (associated) bottom intermediate struts, with or without an intermediate piece. This produces a stable connection with a simple operation by virtue of the fact that in order to clamp the vertical side struts to the associated top side struts and the associated bottom side struts and/or in order to clamp the vertical intermediate struts to the associated top and bottom intermediate struts, fastening pieces are inserted into rear fastening sections of the top side struts and bottom side struts oriented toward the vertical struts and into rear fastening sections of the top and bottom intermediate struts oriented toward the vertical intermediate struts, which fastening pieces are equipped with threaded bores and extend perpendicular to the longitudinal axes of the top and bottom struts, and clamping screws that are guided through the associated vertical [side] struts and associated vertical intermediate struts are screwed into these threaded bores.

It is also advantageous that the vertical side struts and the associated bottom side struts are connected by means of a stiffening bracket. For stability it is also advantageous that in the rear region of the two side frames, spaced apart from the vertical strut in the forward direction, a respective vertical support strut is installed between the bottom and top side struts. Correspondingly, spaced apart from the vertical intermediate struts in the forward direction, support struts are also installed between the associated bottom struts and top struts, with the front sides of all of the support struts being aligned with one another parallel to the rear plane. In the support struts built into the side frames, laterally protruding mounting surfaces on the outside have been omitted.

The structure and function of the refrigerated display case also benefits from the fact that the cover panels include thermally insulating plate-shaped elements that are fastened to the inside of the side frames and intermediate frames oriented toward the cooling chamber.

Other advantages for the construction and function are achieved in that the support struts are provided with rows of holes with a predetermined spacing pattern, in which support arms that protrude forward into the cooling chamber can be hung and in that the support struts made of metal are installed in a supporting fashion relative to the top and bottom side struts likewise made of metal and relative to the bottom and top intermediate struts by means of thermally insulating intermediate pieces. The structure of the device also includes vertically adjustable front and rear feet are fastened to the bottom side struts and bottom intermediate struts.

BRIEF DESCRIPTION OF THE DRAWINGS

The drawings illustrate a preferred embodiment including the above-noted characteristics and features of the device. The device will be readily understood from the descriptions and drawings. In the drawings.

DETAILED DESCRIPTION OF PREFERRED EMBODIMENTS

Figure 1:
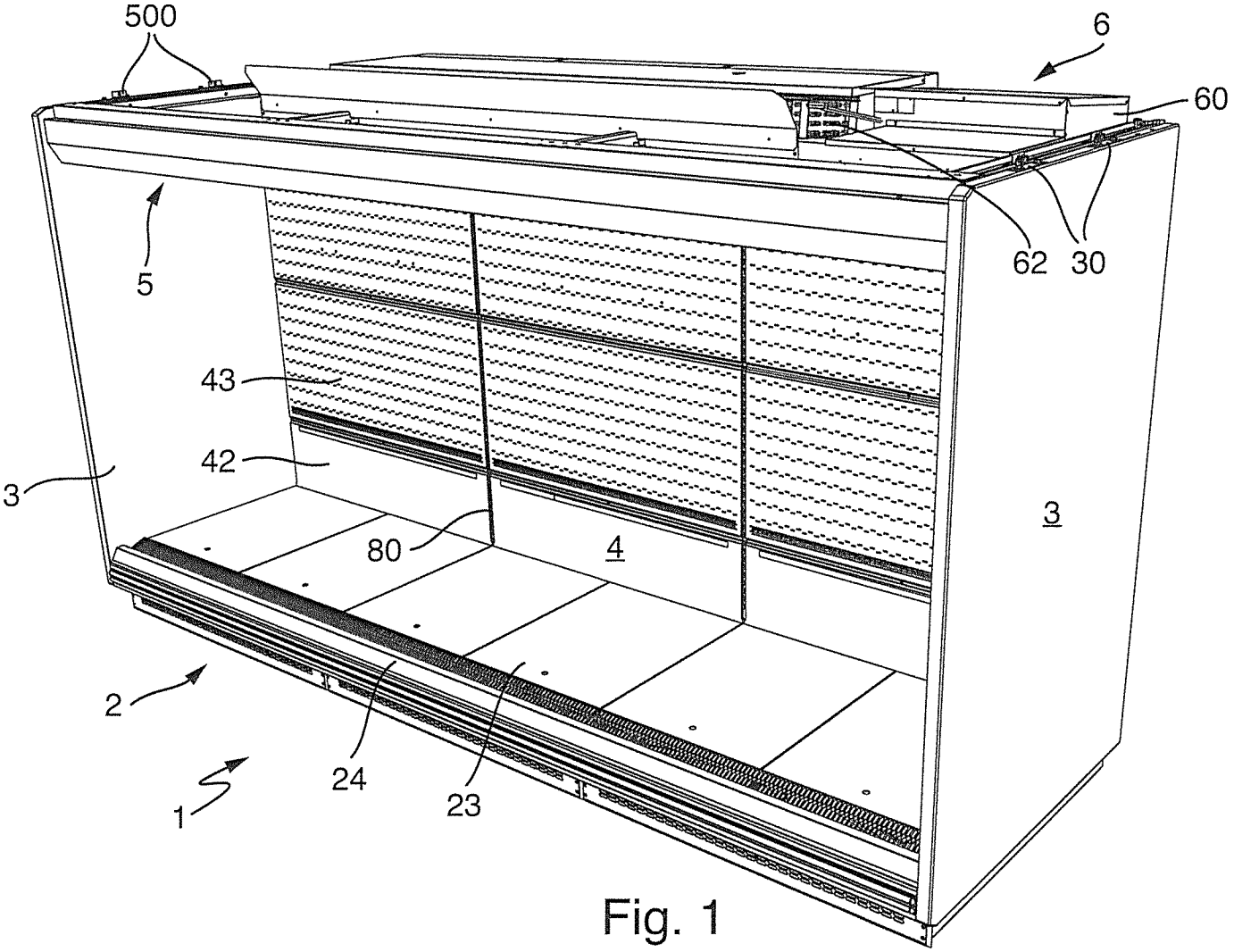
FIG. 1 is a perspective view of a refrigerated display case, in an oblique view from above, with a bottom assembly, a rear wall assembly, a top assembly, and two side walls.

FIGS. 1-6E illustrate a refrigerated display case 1. FIG. 1 shows a refrigerated display case 1 in a perspective view with a bottom assembly 2, a rear wall assembly 4, a top assembly 5, and two side walls 3 delimiting a cooling chamber at the bottom, rear, top, and sides. To cool the cooling chamber and products contained therein, a cooling device 6 is provided, some of whose components—namely a cooling unit 60 with a control unit and a heat exchanger 62—are shown, which are accommodated in or on the top assembly 5. Other components of the cooling device 6, such as flow ducts for the cooling air, compressors, and fans, are accommodated in the rear wall assembly 4 and bottom assembly 2.

Bottom assembly 2 is closed toward the front by a pedestal cover unit 24 and toward the cooling chamber by a plurality of plate-shaped bottom covering elements 23 and includes one or more thermally insulating bottom cover elements, for example composed of a plastic foam as well as sections of cooling air ducts that transition at the back into corresponding sections of cooling air ducts in rear wall assembly 4.

In the direction toward the cooling chamber, rear wall assembly 4 is closed by a plurality of plate-shaped elements, namely lower rear wall elements 42 and rear wall elements 43 situated above the latter; in particular, rear wall elements 43 are provided with numerous openings to allow cooling air to flow out into the cooling chamber. FIG. 1 also shows vertical support struts 80, which serve to stabilize refrigerated display case 1 frame (not otherwise visible in this figure) and which are also embodied for attachment of rear wall elements 42, 43 and for hanging support arms (likewise not shown) that protrude forward into the cooling chamber for holding shelves, for which purpose support struts 80 are provided with rows of holes spaced a particular distance apart. In addition, rear wall assembly 4 and top assembly 5 are provided with thermally insulating insulation plates that enclose the outside of the cooling ducts relative to the cooling chamber. Side walls 3 can likewise be clad with thermal insulation material or be composed thereof. The cooling air flow assisted by the fans travels in a largely closed circular flow through bottom assembly 2, the rear wall assembly 4, and top assembly 5, and in a cooling air curtain that travels from top to bottom across the front side; it flows out and down through a laminar cover in top assembly 5 and travels through a laminar grating and back into the sections of the cooling air ducts in the bottom assembly 2. In the front region of top assembly 5, a roller curtain for closing the cooling chamber can be provided, e.g., to keep the cooling air in the cooling chamber during non-business hours.

Figure 2:
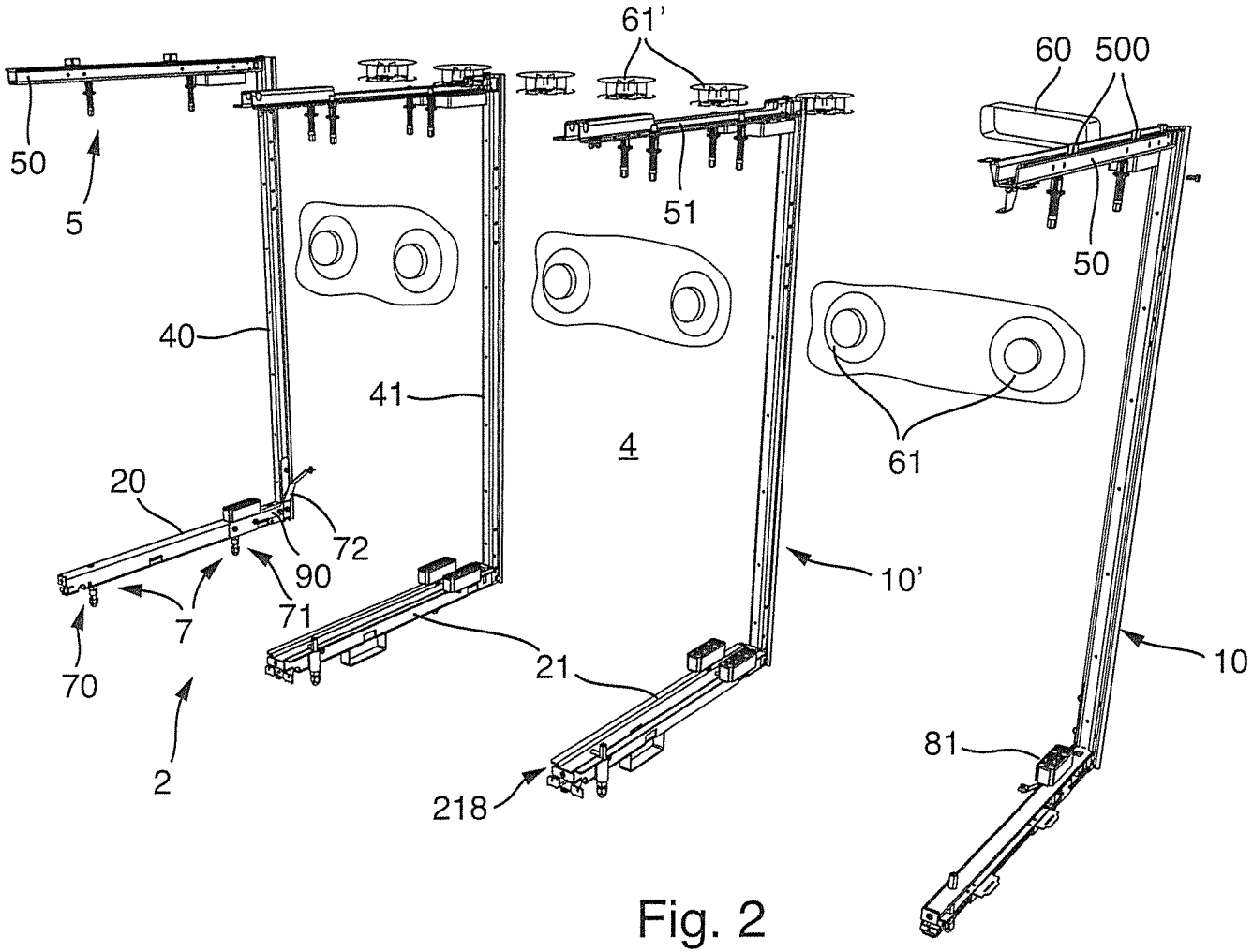
FIG. 2 is a frame of the refrigerated display case with C-shaped side frames and intermediate frames as well as components of a cooling device.

As FIG. 2 shows, refrigerated display case 1 has a support structure in the form of a frame with a plurality of frames that are C-shaped when viewed from the side, namely two side frames 10 and intermediate frames 10' situated between the latter and preferably spaced equidistantly apart from one another; two intermediate frames 10' are shown in FIG. 2. The distance between successive frames corresponds, for example, to the width of a conventional shelf module 1.25 m wide (one column); the shelf arrangement in FIGS. 1 and 2 is embodied with three columns and, for example, is 3.75 m wide. The intermediate frames 10' produce an advantageous, stable, continuous connection of the shelf modules. Frames 10 and intermediate frames 10' in this case are arranged on the outside of the refrigerated display case 1 in relation to the cover panels—particularly in relation to the thermally insulating insulation plates—so as to avoid cold bridges to the outside and also to facilitate the assembly steps during setup of refrigerated display case 1. On the underside, frames 10 and intermediate frames 10' are provided with a bottom support 7, which has front and rear feet 70, 71. Also in the exemplary embodiment shown, an adjustable securing support element 72 is embodied at the bottom of the back of side frame 10 to provide additional steadiness. FIG. 2 also shows fans 61 provided in rear wall assembly 2 and fans 61' provided in the top assembly.

Side frames 10 each have a vertical side strut 40, which is attached at its bottom end to a bottom side strut 20 protruding forward in the depth direction and is attached at its top end to a top side strut 50 protruding forward in the depth direction. Intermediate frames 10' each have a vertical intermediate strut 41, which is attached at its bottom end to a bottom intermediate strut 21 protruding forward in the depth direction and is attached at its top end to a top intermediate strut 51 protruding forward in the depth direction. In order to connect vertical side strut 40 to bottom side strut 20 (possibly in addition to other connecting elements), a stiffening bracket 90 can be mounted in the lower region, with one leg oriented toward the front along bottom side strut 20 and the other oriented upward along vertical side strut 40.

Bottom struts 20, top struts 50, bottom intermediate struts 21, and top intermediate struts 51 are preferably oriented horizontally and at right angles to associated vertical struts 40 and vertical intermediate struts 41. To stiffen frames 10 and intermediate frames 10', between bottom strut 20 and respective top strut 50 and between bottom intermediate strut 21 and top intermediate strut 51, support struts 80 shown in FIG. 1 are mounted in the rear region of refrigerated display case 1, spaced apart by the same distance from vertical struts 40 and vertical intermediate struts 41; the ends of support struts 80 are supported on bottom strut 20 or bottom intermediate strut 21 by thermally insulating support blocks 81 and corresponding thermally insulating elements are also situated between the upper end of support strut 80 and associated top strut 50 or top intermediate strut 51 in order to avoid cold bridges to the frame parts situated on the outside since support struts 80 and also the horizontal and vertical frame legs in the form of vertical side struts 40, vertical intermediate struts 41, bottom side struts 20, bottom intermediate struts 21, top side struts 50, and top intermediate struts 51 are preferably composed of metal, in particular steel, in order to ensure the required stability and favorable mounting options.

Support struts 80 that are built into intermediate frame 10' also have, for example, mounting flanges on both sides, which are bent parallel to the plane of the rear wall. On support struts 80 incorporated into side frames 10, however, there is preferably only one mounting flange oriented toward the inside, parallel to the plane of the rear wall, while there is no mounting flange oriented toward the outside.

As FIG. 2 also shows, side frames 10 and intermediate frames 10' are designed differently. Vertical side struts 40 are embodied in the form of profiles with a hat-shaped cross-section, i.e., with a middle section that is U-shaped in cross-section and with the free ends of the U-legs bent outward at right angles. This design achieves advantageous mounting options; the U-piece and the U-legs that are bent outward at right angles constitute flange-like mounting surfaces, which are parallel to and spaced apart from one another by a definite distance and in which mounting bores can be provided at suitable locations.

Top side struts 50 of the side frames are also embodied in the form of a profile with a hat-shaped cross-section corresponding to that of the vertical struts 40. In both vertical struts 40 and top struts 50, the profile cavity is open toward the outside. This achieves a stable mounting of the frame elements to one another and also provides advantages in the mounting of the plate-shaped cover panels and side walls 3. Bottom side struts, by contrast, are preferably embodied in the form of a closed rectangular or square hollow profile or in the form of a C-shaped profile, permitting a high degree of stability in connection with bottom support 7 and simultaneously good mounting options for vertical struts 40 and side walls 3.

In the intermediate frames 10', the vertical intermediate struts 41 and the top intermediate struts 51 are likewise composed of a profile with a hat-shaped cross-section, with the profile dimensions in the cross-section advantageously corresponding to the profile dimensions of the vertical struts 40 and top struts 50. The top intermediate struts 51, however, are oriented with their open side oriented downward toward the cooling chamber in order to provide better mounting options on the inside of the cooling chamber and on the outside of the top assembly 5. To this end, the top intermediate struts 51 are provided with cutouts 510 on top, which, in the example shown, extend approximately from the front third into the vicinity of the rear end. For example, components of the cooling device 6 such as a heat exchanger 62 can be definitely positioned in the cutouts on top.

Bottom intermediate struts 21 are likewise composed of a profile with a hat-shaped cross-section, with the opening of the profile cavity oriented upward toward the cooling chamber. The resulting angled side flanks situated at the top provide advantageous mounting surfaces for the covering elements and e.g., for the support blocks 81. On the side flanks of the U-legs of the middle profile section, front and rear feet 70, 71 are accommodated in a stable, adjustable fashion in corresponding sockets. The profile cross-section of bottom intermediate struts 21 is wider than the profile cross-section of vertical and top intermediate struts 41 and 51 in order to achieve more favorable mounting options.

Figure 3:
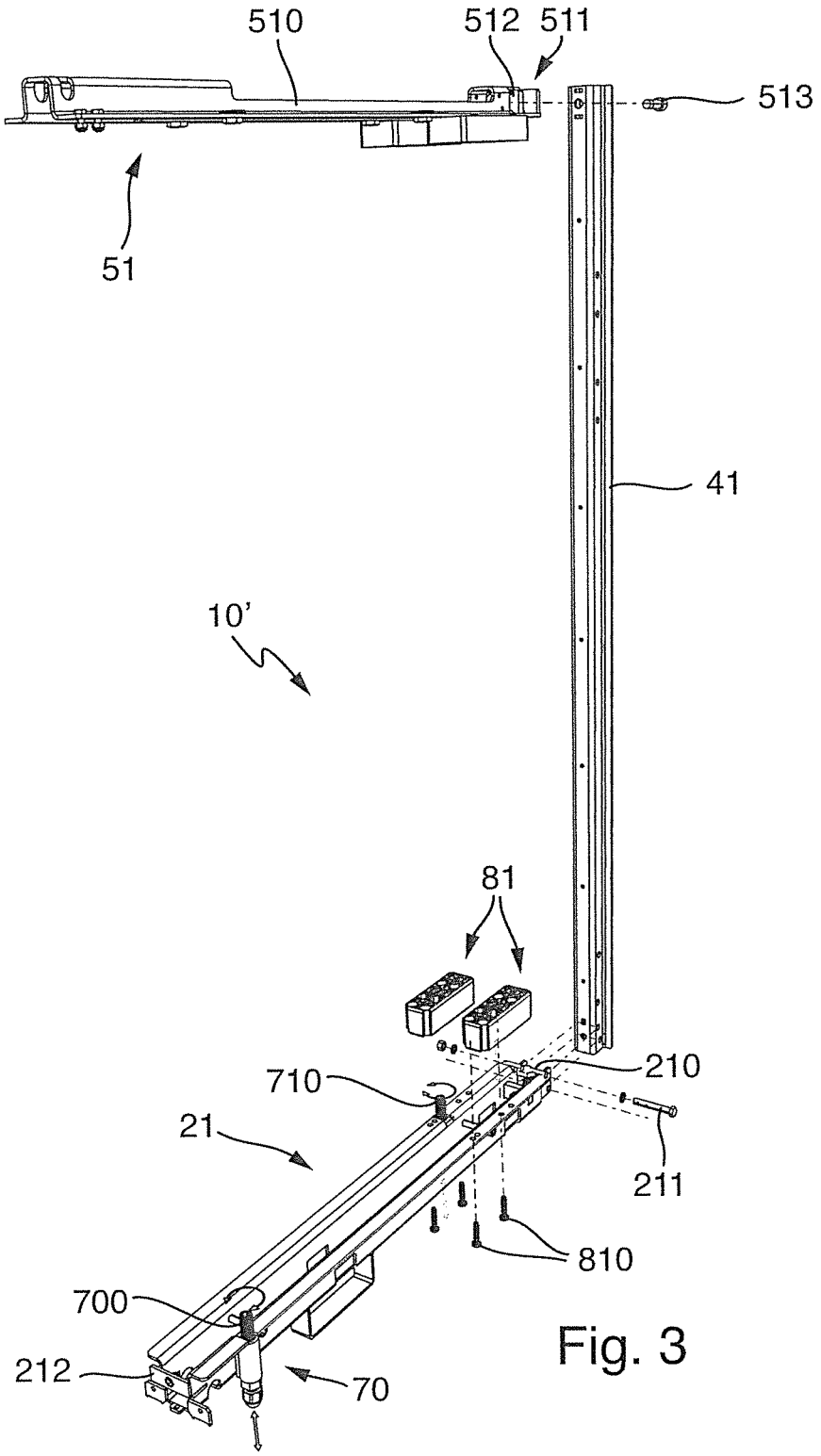
FIG. 3 is a perspective, exploded view of an intermediate frame.

FIG. 3 shows a perspective, exploded view of an intermediate frame 10'. In this case, the top intermediate strut with its cutout 510 is clearly visible; cutout 510 is adjoined by a rear, upper fastening section 511, the end of which is brought into contact with the part of the U-section of vertical intermediate strut 41 oriented toward it, either directly or indirectly with the interposition of an intermediate piece, and is clamped by means of a fastener 513 in the form of a fastening screw that is inserted from the rear side through a corresponding bore in vertical intermediate strut 41. The fastening screw in this case is screwed into a threaded fastening bore provided in a fastening piece 512 that is inserted into transverse slots which are provided in the top intermediate strut 51 at right angles to the longitudinal axis of the strut.

The connection of the lower section of vertical intermediate strut 41 to bottom intermediate strut 21 is also provided at the end of the bottom intermediate strut 21. For this purpose, in a bottom, rear fastening section 210 of bottom intermediate strut 21, a contact piece is inserted, to which vertical intermediate strut 41 is fastened, as described in greater detail below.

FIG. 3 also shows the mounting of thermally insulating support blocks 81, which are composed of a stable plastic material, to the outward-oriented flange-like sections of bottom intermediate strut 21 by means of fastening screws 810. FIG. 3 also shows the mounting of front and rear foot 70, 71 to bottom intermediate strut 21. To this end, a respective socket is mounted to each of the U-legs of the U-section of bottom intermediate strut 21, which socket is provided with or connected to an internal thread in order to accommodate a threaded bolt 700, 710 of front or rear foot 70 in a vertically adjustable fashion. The threaded bolt protrudes upward beyond the top surface of bottom intermediate strut 21 and in its upper section, has a fitting for a tool such as a socket for an Allen wrench. This design allows front and rear foot 70, 71 to be easily adjusted from above, i.e., from the interior of the refrigerated display case, as shown by the arrows pointing in the rotation direction and the vertical direction. In particular, even rear foot 71 which is shifted toward the front approximately into the vicinity of support strut 80 and in fact, somewhat forward of the longitudinal axis thereof can be easily actuated in this way for the vertical adjustment.

Support blocks 81 and possible cover elements have corresponding access openings or can be easily removed from the vicinity of the tool fitting. Front and rear feet 70, 71 are mounted on the two different legs of the U-section, which also provides an increased stability.

Figure 4A:
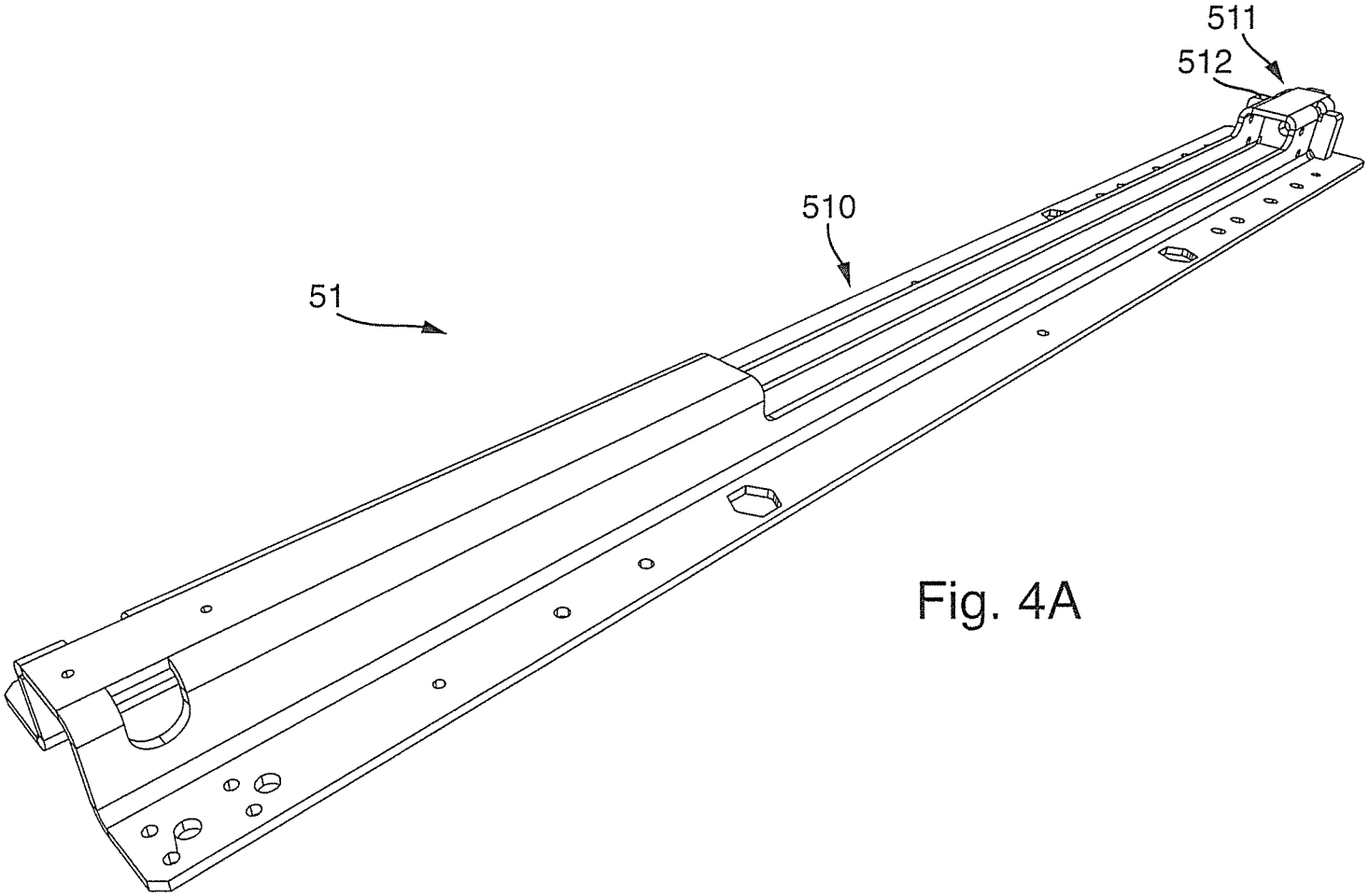
FIG. 4A is a perspective view of a top intermediate strut of the intermediate frame.

FIG. 4A is an enlarged depiction of top intermediate strut 51, with upper fastening section 511 and fastening piece 512, which is inserted into a transverse slot therein and which is provided with a threaded bore for the above-mentioned fastening screw 513 for attaching vertical intermediate strut 41. Cutout 510 in the upward-oriented U-section of the profile is also clearly visible. Mounting openings for mounting relevant components are provided in the U-piece and in the legs that are bent outward at right angles.

Figure 4B:
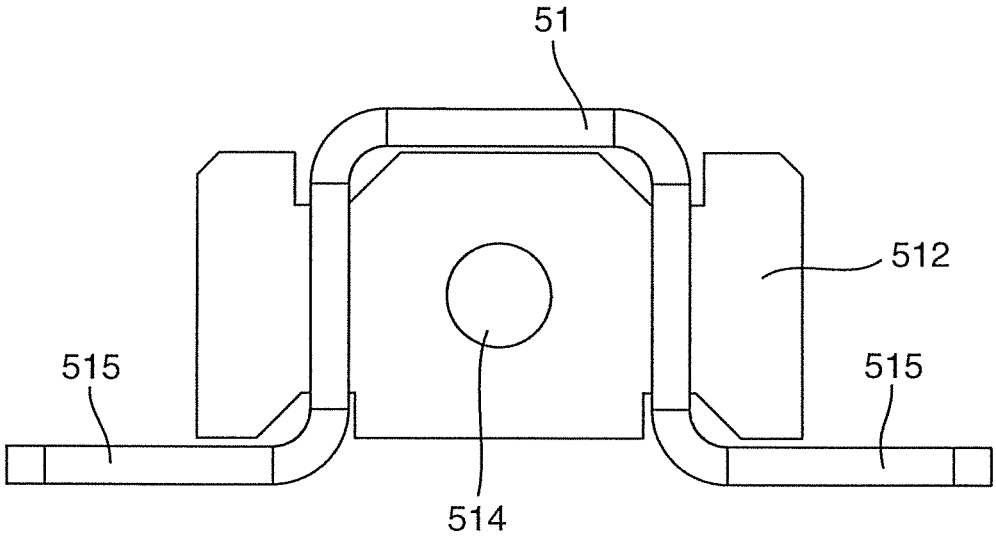
FIG. 4B shows a rear view of the top intermediate strut according to FIG. 4A.

FIG. 4B shows a rear view of top intermediate strut 51; bore 514, which is preferably provided with an internal thread, is situated in the middle region of fastening piece 512, whose lateral segments protrude outward over the U-legs of top intermediate strut 51 through the transverse slot provided therein. In order to be able to favorably center vertical intermediate strut 41, fastening piece 512 is inserted into the transverse slot with play and has respective holding notches in the region of the U-legs of top intermediate strut 51. To facilitate the insertion and securing of fastening piece 512 that is inserted into the transverse slot with play, the fastening piece has two groove-shaped recesses at the top and bottom in the region of the U-legs; the lower recesses are provided with inclined flanks on the outside and steep flanks on the inside while the upper recesses are provided steep flanks on the outside and inclined flanks on the inside. FIG. 4B also shows angled flange (side flange) 515 of intermediate strut 51.

Figure 4C:
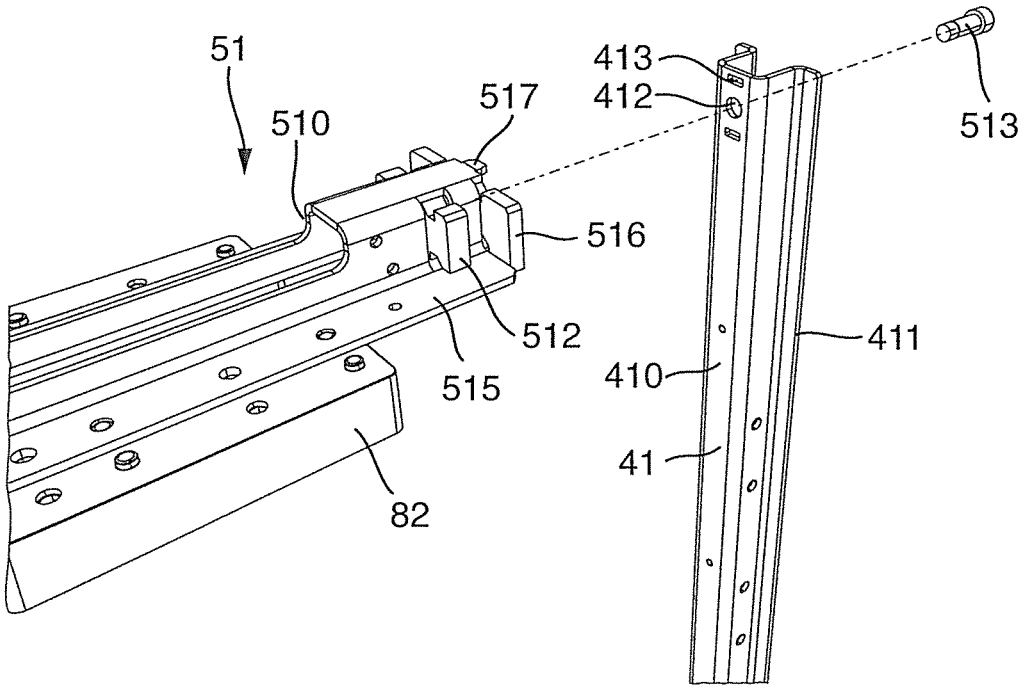
FIG. 4C is a perspective view of a detail of the intermediate frame in its upper rear corner, in an exploded view of the top intermediate strut and the vertical intermediate strut.

FIG. 4C shows upper rear fastening section 511 of top intermediate strut 51 and the associated section of the respective vertical intermediate strut 41. At the end of top intermediate strut 51, at right angles to the longitudinal axis of the intermediate strut, an intermediate piece 516 is mounted, which constitutes a defined, stable contact for the U-piece of vertical intermediate strut 41. Above intermediate piece 516, an edge of the U-piece of top intermediate strut 51 protrudes, the end of which is connected to a fixing lug 517 that protrudes even further, which is inserted into an adapted receiving opening 413 in the upper section of vertical intermediate strut 41 and constitutes a positioning aid. Next, fastener 513 embodied in the form of a clamping screw can be inserted through a precisely positioned bore 412 and a matching bore (not shown in the drawing) in intermediate piece 516 and screwed into the threaded bore of fastening piece 512 in order to clamp vertical intermediate strut 41 to top intermediate strut 51.

FIGS. 5A through 5E show the rear region of bottom intermediate strut 21 with rear foot 71 and the lower section of vertical intermediate strut 41. The U-legs of vertical intermediate strut 41 are inserted between rearward-protruding lateral fixing lugs 212, which protrude rearward from the U-legs of bottom intermediate strut 21 or from a contact piece 213 that is placed against the rear end of bottom intermediate strut 21; the distance between lateral fixing lugs 212 is adapted to the distance between the outsides of the U-section of vertical intermediate strut 41. Lateral fixing lugs 212 and the U-legs of vertical intermediate strut 41 are provided with openings that are to be brought into alignment and through which securing screw 211 is transversely guided in order to clamp vertical intermediate strut 41 to bottom intermediate strut 21.

To facilitate positioning and fixing, the upper edge of contact piece 213 has an additional fixing lug 212 which protrudes rearward and which engages in a fixing opening 414 that is adapted to it in position and shape and is provided in the U-piece of vertical intermediate strut 41. Contact piece 213 can, for example, be fastened by means of a securing screw that is inserted in a direction axial to the bottom intermediate strut 21 into a threaded bore provided in a clamping piece, which is slid into a transverse slot in bottom intermediate strut 21.

Figure 5A:
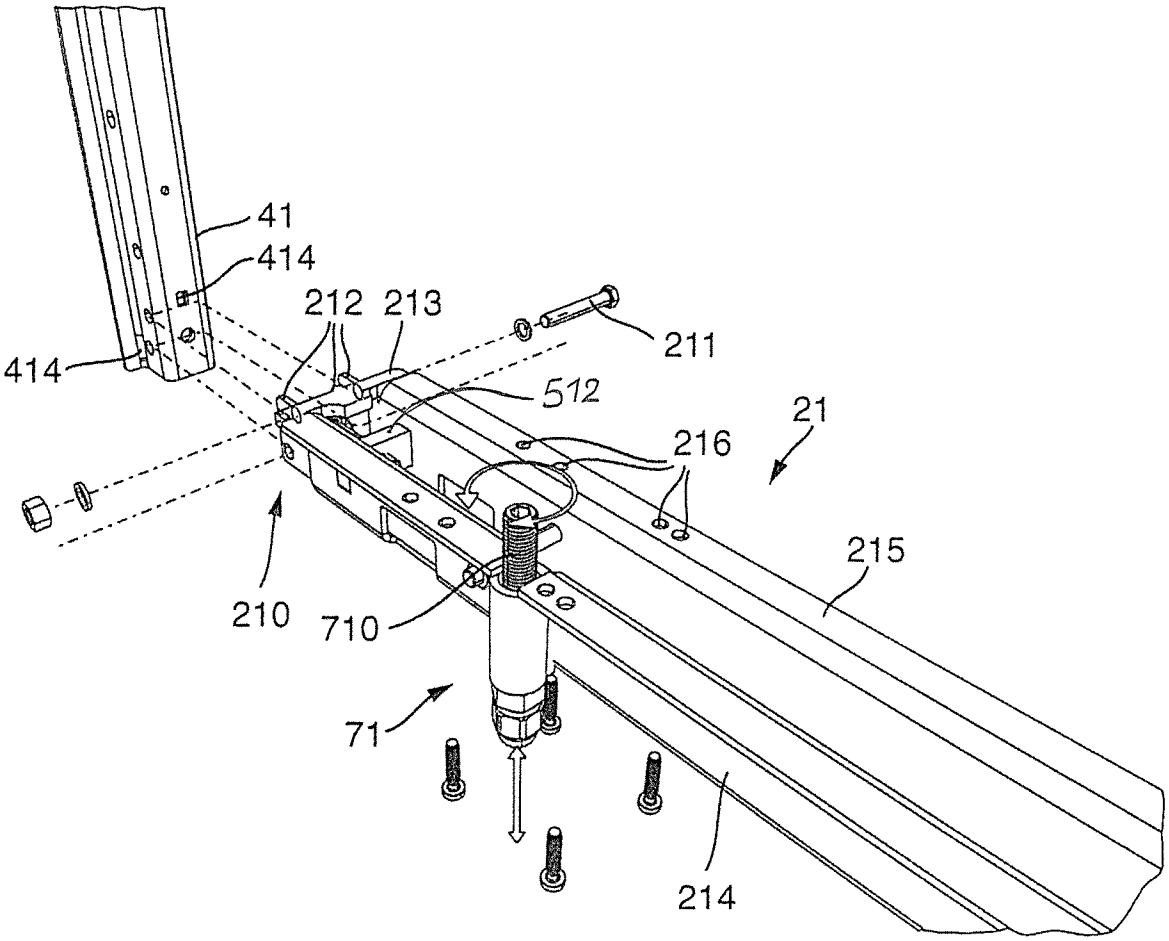
FIG. 5A is a perspective view of a detail of the intermediate frame in its lower corner region, in an exploded view of the vertical intermediate strut and the bottom intermediate strut with a rear foot.

FIG. 5A also shows rear foot 71, which is secured in a stable fashion in a cylindrical socket to a side leg of U-section 214 of bottom intermediate strut 21. The socket itself is provided with an internal thread or is connected to a nut equipped with an internal thread so that threaded bolt 710 of rear foot 71 is guided in a vertically adjustable fashion in the vertical direction. Threaded bolt 710, which is provided with the tool fitting, an Allen socket in the exemplary embodiment, protrudes beyond the top surface of bottom intermediate strut 21; the respective outward-angled flange section 215 has an opening at the point through which threaded bolt 710 passes. In order to increase the stability, particularly in the vicinity of rear foot 71 (and likewise in the region of front foot 70), a screw can be inserted transversely through the U-section of bottom intermediate strut 21 in order to stabilize the alignment of the U-legs. In bent flange sections 215, fastening bores 216 are also provided to allow fastening screws 810 to pass through, e.g., for support blocks 81.

Figure 5B:
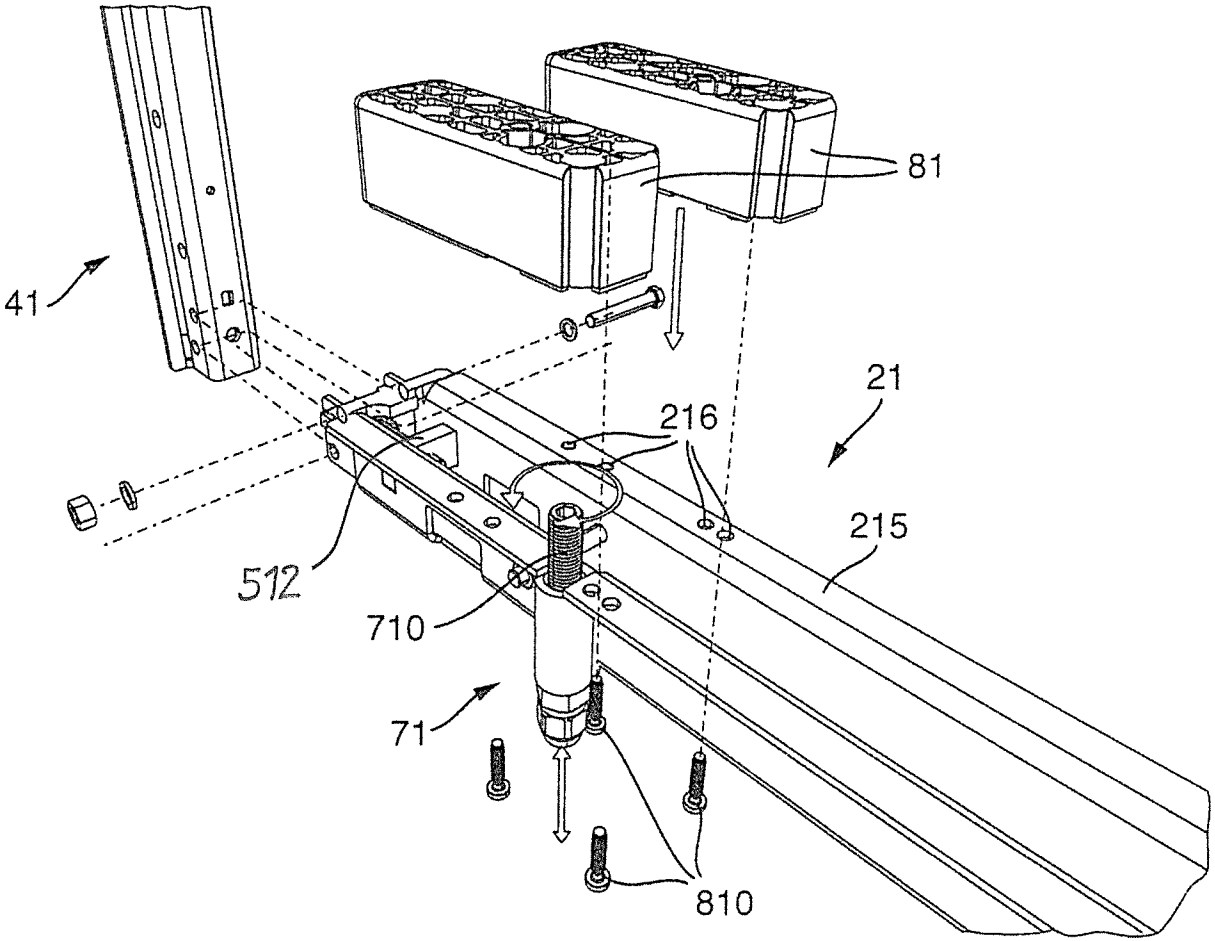
FIG. 5B is a detail of the intermediate frame corresponding to that in FIG. 5A, also depicting support blocks.

FIG. 5B shows the mounting of support blocks 81 by means of fastening screws 810. The drawing also once again shows the above-described fastening of vertical intermediate strut 41 to bottom intermediate strut 21 and mounting and vertical adjustment of rear foot 71, with the rotation and vertical adjustment symbolized by means of arrows.

Figure 5C:
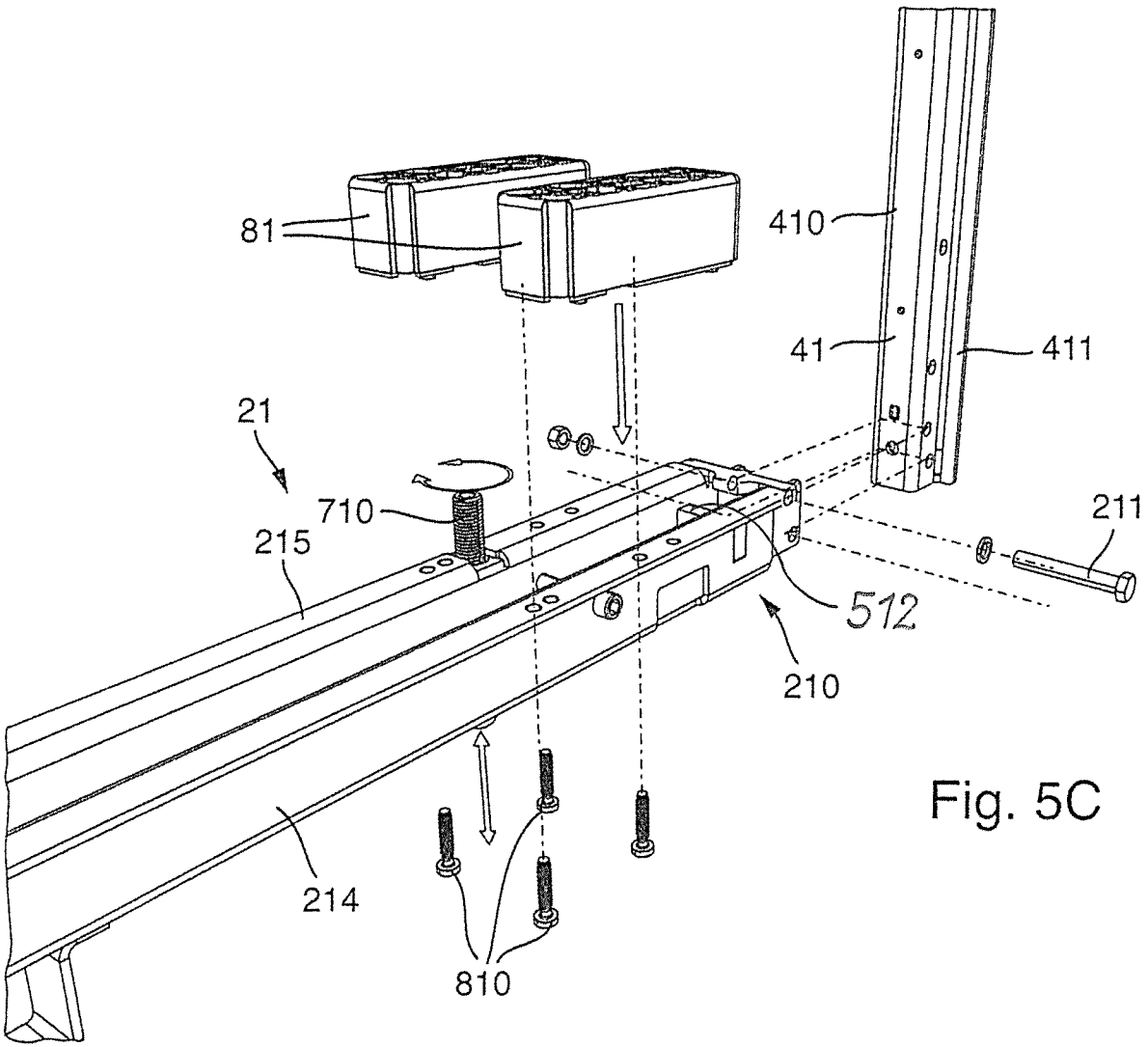
FIG. 5C is perspective view of the detail of the intermediate frame corresponding to that in FIG. 5B, in a perspective view from the other side.

FIG. 5C shows the attachment of vertical intermediate strut 41 by means of its U-section 410 to bottom intermediate strut 21; side flange sections 411 of vertical intermediate strut 41 protrude beyond the end of lateral fixing lugs 212 in the clamped state. In this case, fixing lugs 212, as can also be the case in the exemplary embodiments shown in FIGS. 5A and 5B, are embodied as protruding sections of the U-legs of bottom intermediate strut 21; in this case, contact piece 213 is accommodated between lateral fixing lugs 212 and only in its upper region, by means of sections protruding laterally beyond fixing lugs 212, rests with its end in particular against stepped, outward-angled flange sections 215 of bottom intermediate strut 21 and is supported with its end in a stable fashion in the lower region, for example, against the correspondingly stepped U-piece. FIG. 5C also once again shows rear foot 71 mounted on bottom intermediate strut 21, with threaded bolt 710 and the mounting of support blocks 81 by means of fastening screws 810 in a perspective view from the other side in comparison to FIG. 5B.

Figure 5D:
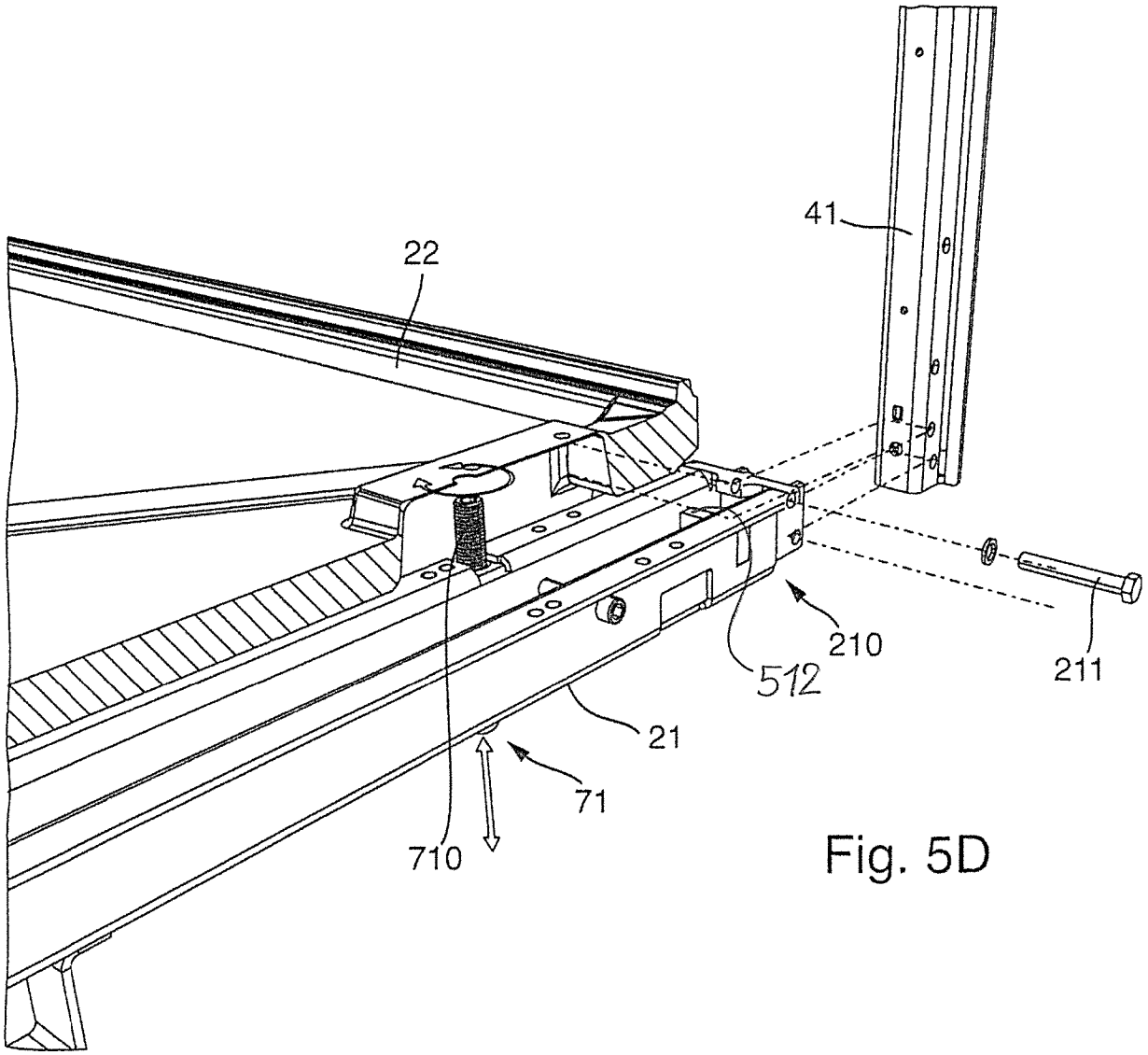
FIG. 5D is a perspective view of another depiction of the intermediate frame according to FIG. 5C, with an insulating bottom cover element without support blocks.

FIG. 5D also shows the mounting of vertical intermediate strut 41 to bottom intermediate strut 21 in the above-described way. It also shows rear foot 71 with threaded bolt 710. As an additional component, the drawing shows a thermally insulating bottom covering element 22, e.g., made of a plastic foam, which is placed onto angled flange section 215 of bottom intermediate strut 21 oriented toward it and can be fastened to this flange section, for example, by means of screws or other fasteners. In the vicinity of threaded bolt 710, bottom covering element 22 is provided with an opening for permitting the vertical adjustment tool to be inserted into threaded bolt 710 and turned in order to perform the vertical adjustment.

As is clear from FIG. 5D, on the underside of bottom covering element 22, an opening is provided into which support block 81 can be inserted, which likewise has a corresponding opening for threaded bolt 710. Since a widened foot of vertical support strut 80 is placed on top of support block 81, this achieves a high stability in the region of rear foot 71 that is supported on the floor. The capacity to be adjusted from above achieves a simple operation of rear foot 71, which is spaced toward the front, apart from the back of refrigerated display case 1.

Figure 5E:
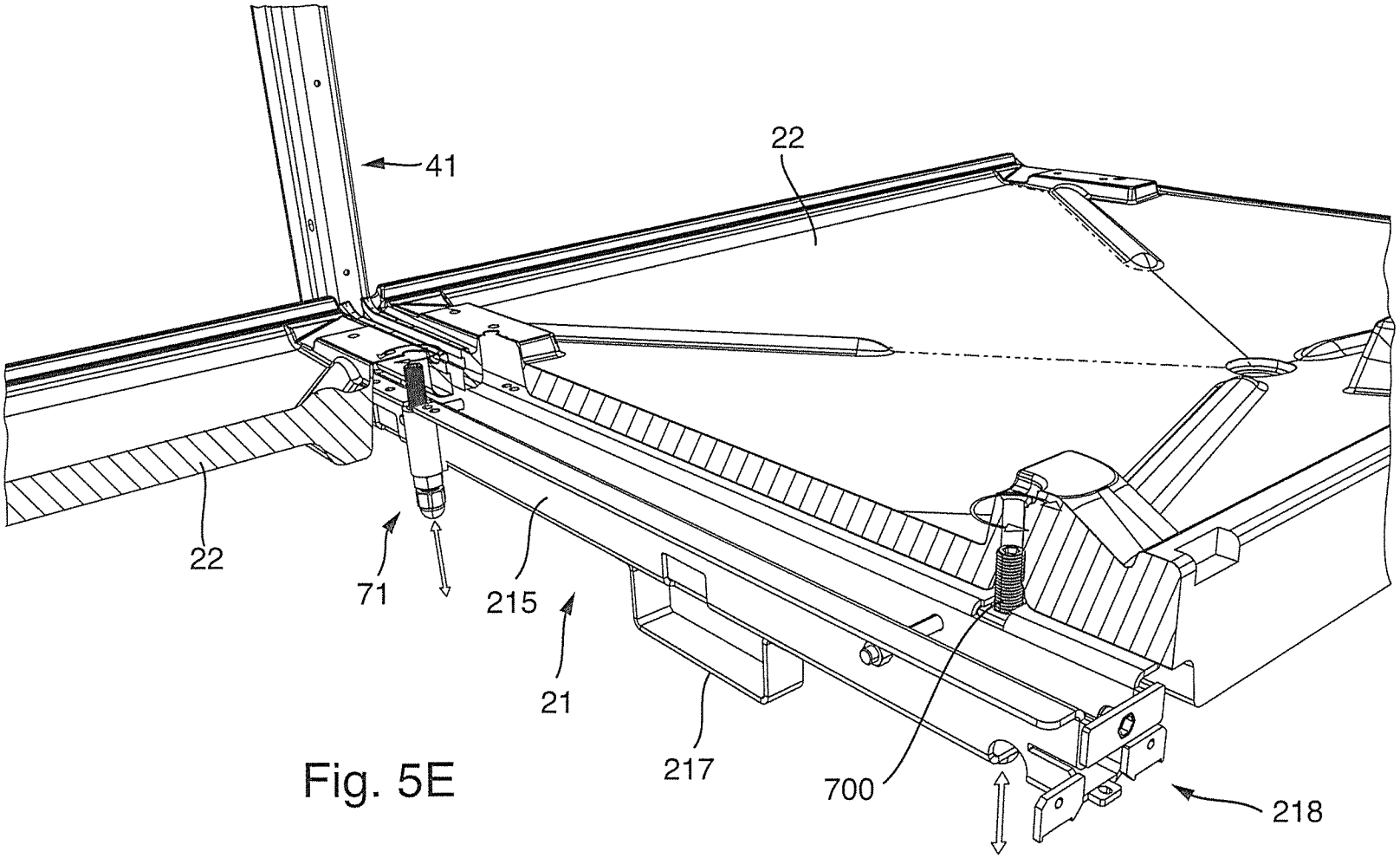
FIG. 5E is a perspective view of the detail of the intermediate frame in the lower region, with a bottom intermediate strut, a vertical intermediate strut, and two plate-shaped insulating bottom cover elements that are positioned on the bottom intermediate strut and are depicted in a partially cut-away view.

FIG. 5E shows the entire length of bottom intermediate strut 21, whose rear fastening section has vertical intermediate strut 41 mounted to it in the above-described fashion. In the exemplary embodiment shown, separate thermally insulating bottom covering elements 22 are laid onto two flange sections 215, between which a seal (not shown) is inserted to produce a seal, which has a mushroom-shaped cross-section, for example. In addition to rear foot 71, which is mounted to bottom intermediate strut 21 in the above-described fashion and is adjustable from above, FIG. 5E also shows front foot 70 with threaded bolt 700, whose upper section is likewise provided with a tool fitting, e.g., an Allen socket, and is accessible from above via an opening in the front region of the respective bottom covering element 22 to perform a vertical adjustment.

The mounting of front foot 70 is preferably embodied in a corresponding fashion to that of rear foot 71, as described above. In this case, however, the cylindrical socket is mounted to the U-leg of the U-section of bottom intermediate strut 21 opposite from that of rear foot 71 and front foot 70 is situated against this U-leg. The vertical adjustment can thus be easily performed from above. The vertical adjustment is thus not hindered even if front foot 70 is shifted a greater or lesser distance toward the rear from the front edge of refrigerated display case 1. As an additional support option, FIG. 5E shows a bracket-like support section 217 that protrudes downward from the U-piece of bottom intermediate strut 21 and is connected to the U-piece.

In addition, in its front section, bottom intermediate strut 21 is provided with a front fastening section 218 to which front pedestal elements or cover elements can be attached. For this purpose, front fastening section 218 has flat contact sections oriented at right angles to the longitudinal axis of bottom intermediate strut 21 at the end of bottom intermediate strut 21.

Figure 5F:
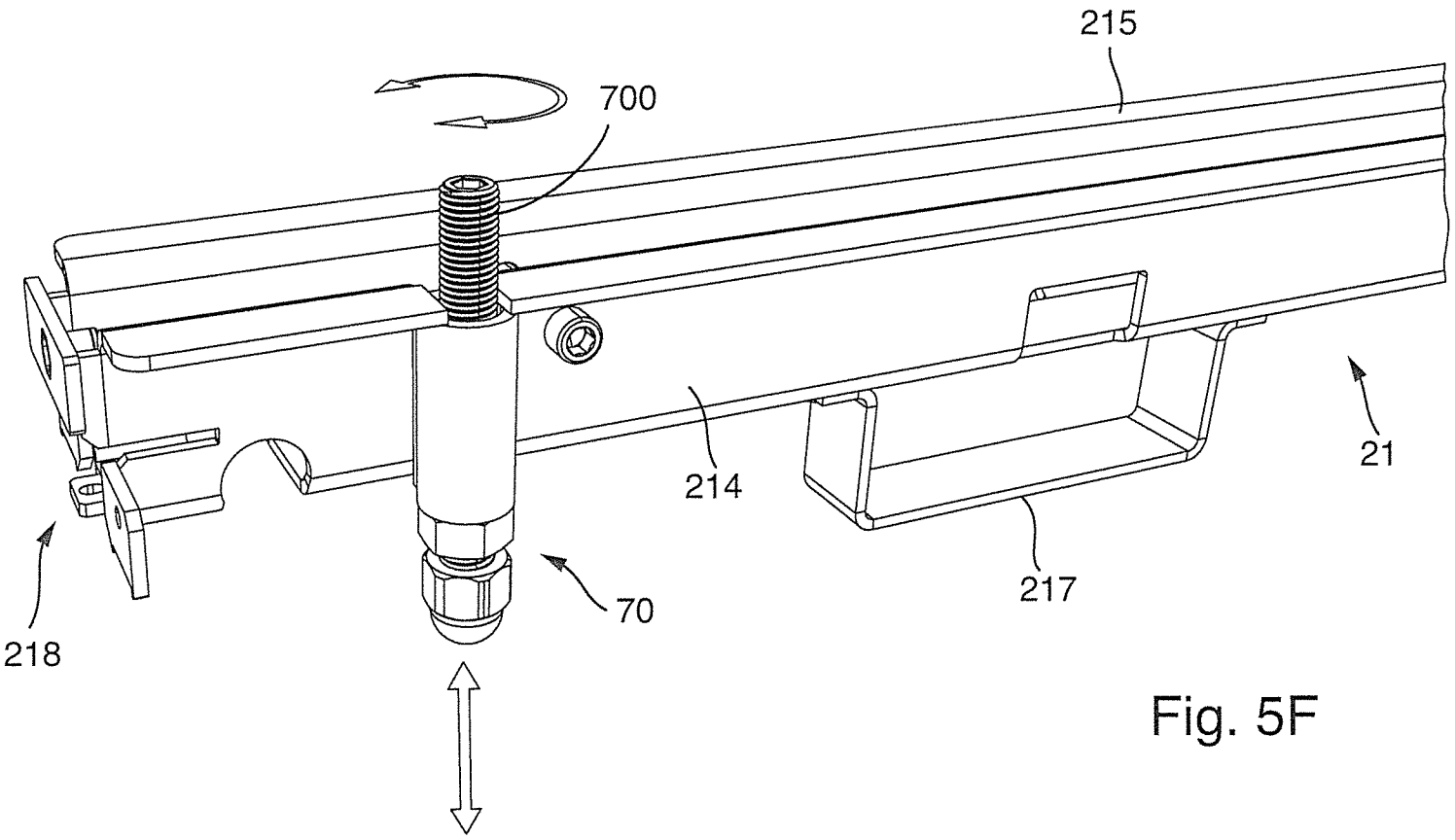
FIG. 5F is a perspective view of a front section of the bottom intermediate strut with a front foot.

FIG. 5F shows an enlarged perspective view of the front section of bottom intermediate strut 21, seen from the other side in comparison to FIG. 5E. The drawing shows front fastening section 218, support section 217, and the vertically adjustable embodiment of front foot 70 with threaded bolt 700 and its attachment to the one U-leg of bottom intermediate strut 21. In the region of threaded bolt 700, the respective angled flange section 215 of bottom intermediate strut 21 likewise has an opening, as in the vicinity of rear foot 71.

Figure 5G:
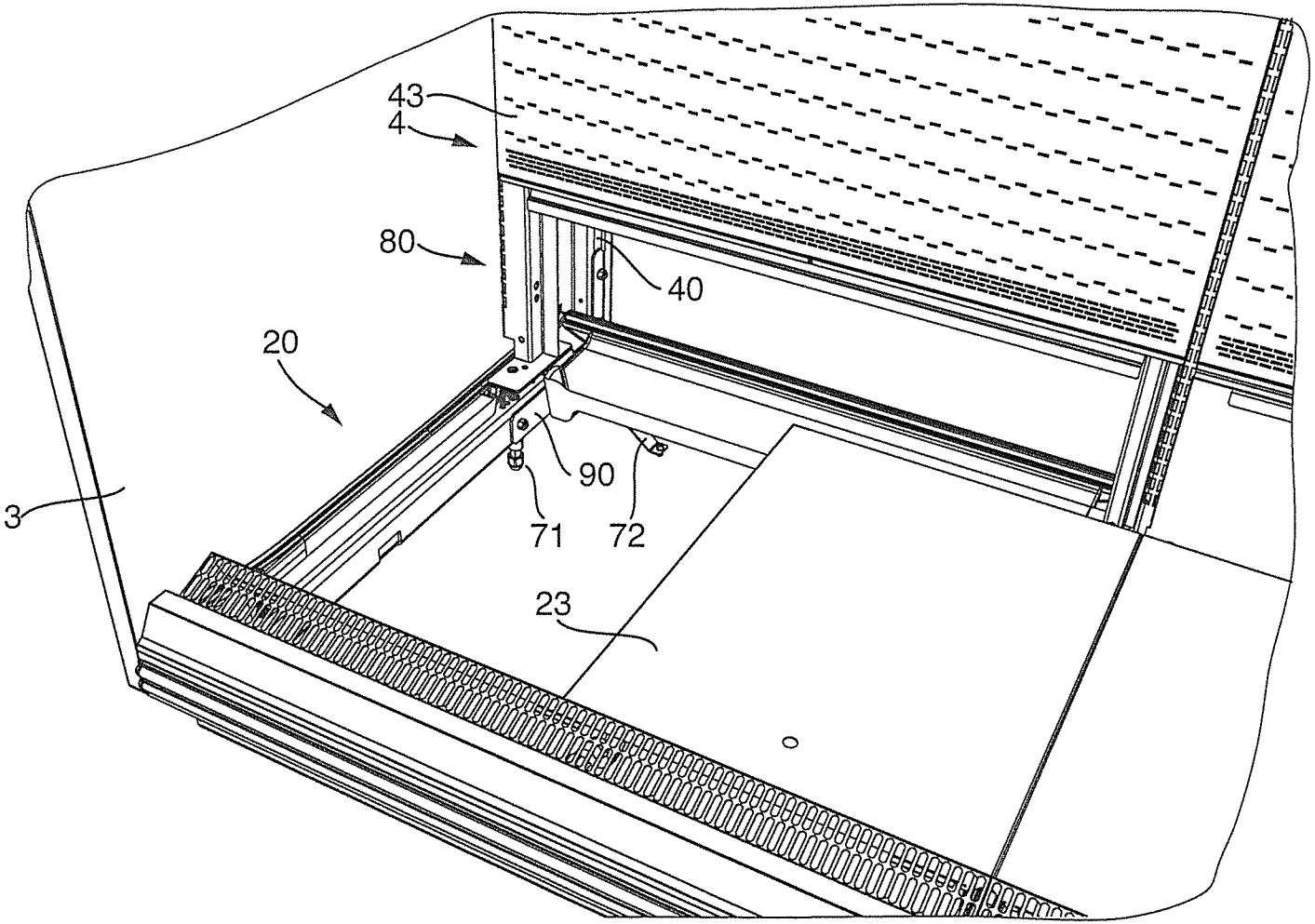
FIG. 5G is a perspective view of the detail of the refrigerated display case in its lower end region, with a partially covered bottom assembly, a rear assembly, and a side wall in a perspective, oblique view from the front.

FIG. 5G shows a lower, side section of the display case, with a section of rear wall assembly 4, rear wall elements 43, vertical side strut 40, and support struts 80; a section of bottom assembly 2, with a bottom side strut 20, rear foot 71 and bottom covering element 23; a section of pedestal cover unit 24; and a section of a side wall 3. The drawing also shows connecting bracket 90 between vertical side strut 40 and bottom side strut 20 and also shows securing support element 72 in the rear region, which has been brought into the support position. To make it easier to access, rear foot 71 has been shifted forward relative to support strut 80 and for the vertical adjustment, is accessible from above via an opening in the foot of support strut 80.

The positioning of rear foot 71 close to the longitudinal axis of support strut 80 makes it possible to absorb heavy weights that can be exerted in this rear region of the display case. On the one hand, specifically in the rear wall region between vertical side struts 40 or vertical intermediate struts 41 and support struts 80 spaced apart from them toward the front, various cooling components, in particular heat exchangers, evaporators, fans 61, and possibly compressors, can be contained in the resulting intermediate space in rear wall assembly 4 and on the other hand, support arms, which protrude forward into the cooling chamber and are for the products to be contained, are hung on support struts 80.

Figure 5H:
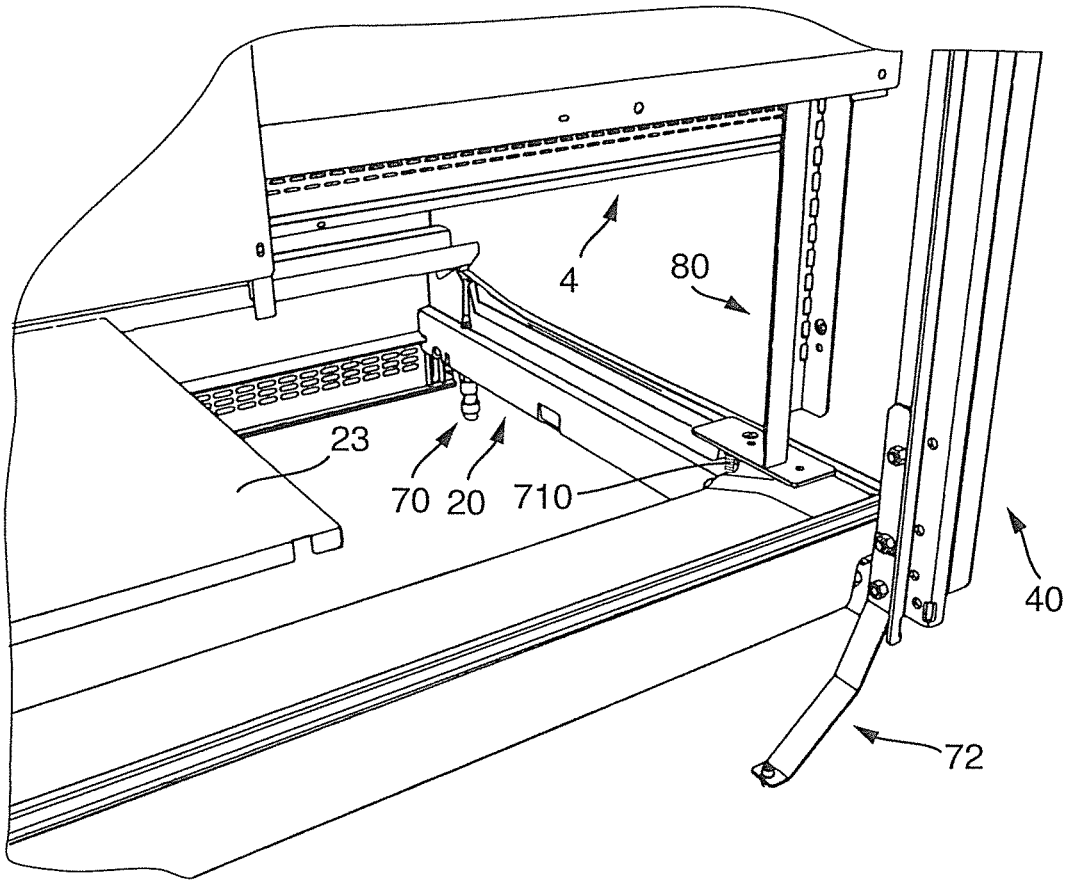
FIG. 5H is a perspective view of the detail of the refrigerated display case according to FIG. 5G in a perspective, oblique view from the rear.

Similarly to FIG. 5G, FIG. 5H shows a detail of a lower corner region of refrigerated display case 1, but in a perspective view from the rear. The drawing shows bottom side strut 20 and vertical side strut 40 attached to rear fastening section 210 thereof, as well as support strut 80, which is supported with its foot on the top surface of bottom side strut 20. The drawing also shows front foot 70 and threaded bolt 710 of rear foot 71 as well as securing support element 72, which is shown brought into the support position and which is fastened to vertical side strut 40 in a removable or vertically pivotable fashion by means of screws.

Figure 5I:
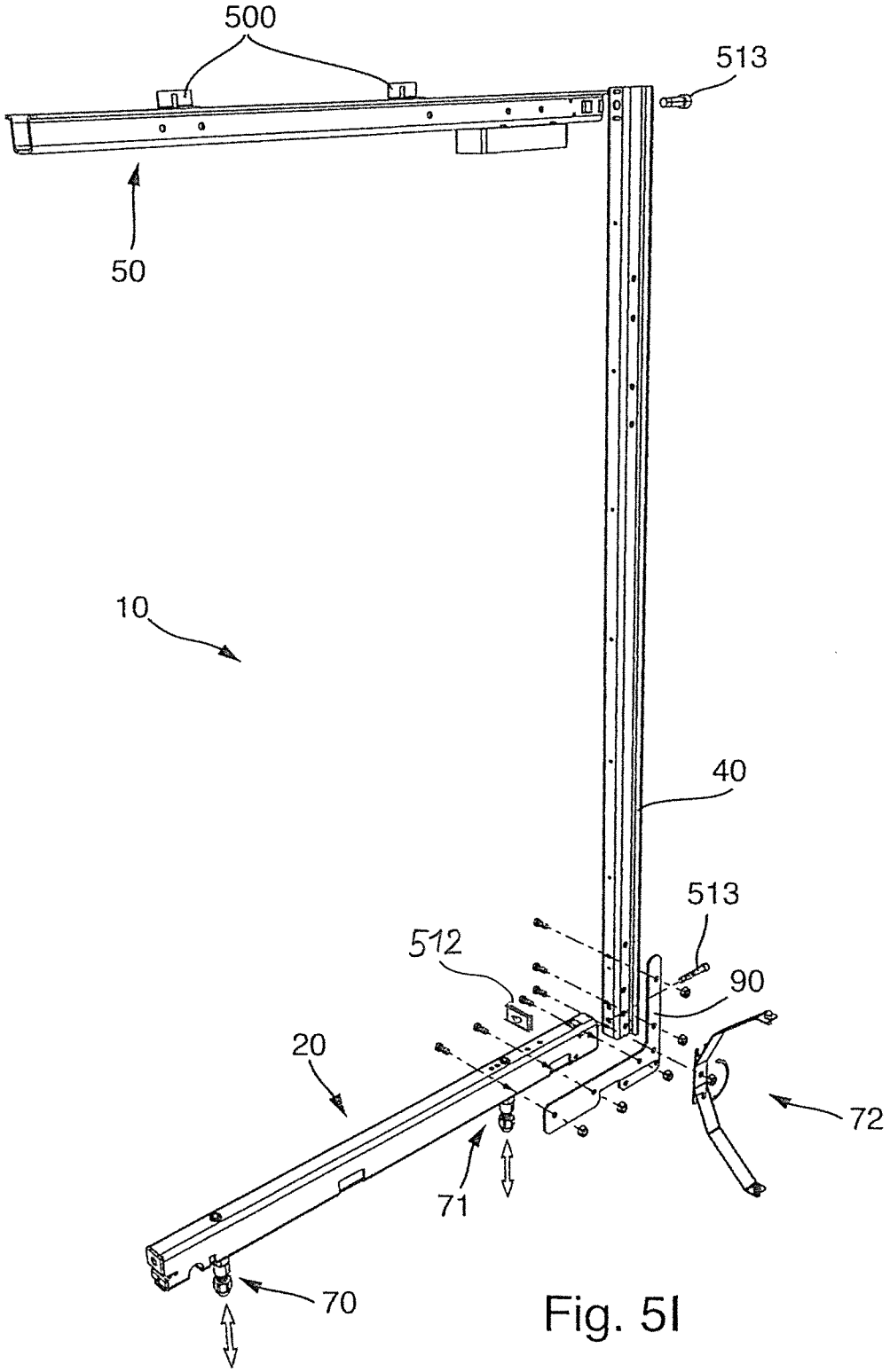
FIG. 5I is a perspective, exploded view of a side frame.

FIG. 5I shows a side frame 10 with a vertical side strut 40, a top side strut 50, and a bottom side strut 20 in a perspective, exploded view. Vertical side strut 40 is fastened to the rear fastening section of top side strut 50 in a fashion corresponding to that described above in connection with the intermediate frame 10'. By contrast with top intermediate struts 51, though, top side strut 50 in this case is rotated by 180° with its open side upward and also has no cutout in the U-section region since no mounting options, or at least only a few of them, are required for top-mounted units such as cooling components of cooling device 6 situated on top and in addition, advantages are achieved with regard to stability and side wall mounting, as explained further below.

Vertical side strut 40 is once again connected to top side strut 50 by means of a clamping screw; the U-piece of vertical side strut 40 is clamped against the rear end of top side strut 50, with or without the interposition of an intermediate piece.

The U-piece of the rear section of vertical side strut 40 is clamped against the end of bottom side strut 20, with or without the interposition of an intermediate piece. In the rear end section of the bottom side strut, a fastening piece 512 with an internal thread, e.g., inserted into a transverse slot in the bottom side strut, is used for mounting vertical side strut 40 in a stable fashion by means of a fastener 513, in particular a clamping screw that is inserted through an adapted opening in the U-piece of vertical side strut 40.

In this regard, in the exemplary embodiment shown, the connection between vertical side strut 40 and bottom side strut 20 is embodied differently from the connection between vertical intermediate strut 41 and bottom intermediate strut 21 and corresponds more to the fastening approach used between the upper section of vertical side strut 40 and top side strut 50. In addition, the lower section of vertical side strut 40 and the rear section of bottom side strut 40 are connected to each other via stiffening bracket 90 by means of fasteners 900 in the form of clamping screws; stiffening bracket 90 is brought into contact with the inside of the U-leg of vertical side strut 40 oriented toward the cooling chamber and into contact with the inner side profile segment of bottom side strut 20 oriented toward the cooling chamber and is screw-mounted there so that stiffening bracket 90 can absorb heavy weights.

FIG. 5I also shows front and rear feet 70, 71 that protrude from the underside of bottom side strut 20, which feet can likewise be advantageously embodied as vertically adjustable from above or can also be adjustable from the side since they are situated close to the lateral edge of refrigerated display case 1. Feet 70, 71 are secured to the lower profile segment and preferably also, to the upper profile segment, of bottom side strut 20 since bottom side strut 20 is embodied as a square, rectangular, or C-shaped hollow profile, as described above. In the drawing, securing support element 72 is shown pivoted upward, i.e., not in the supporting position, and is detachably mounted to the lower end section of vertical side strut 40.

Figure 5J:
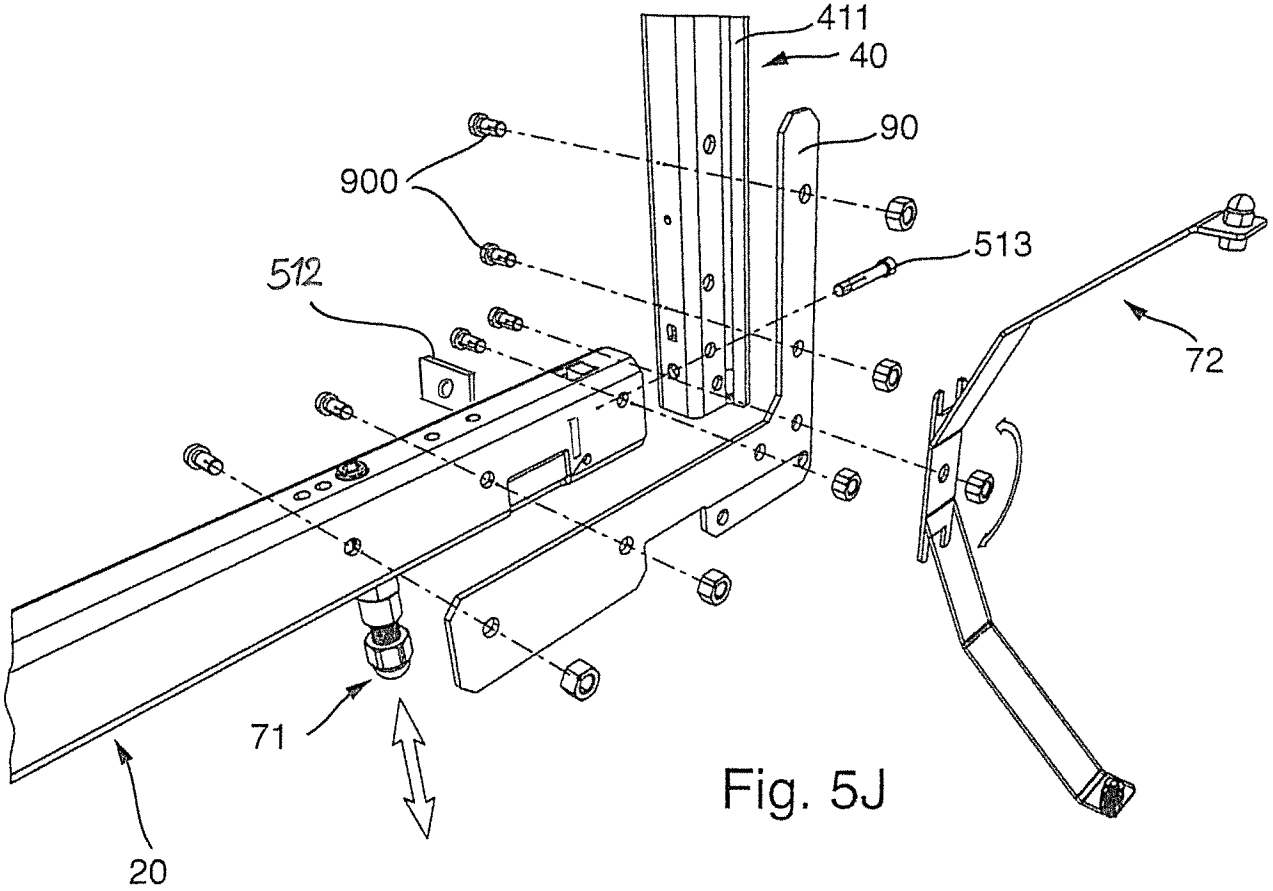
FIG. 5J is a perspective, exploded view of a lower, rear corner region of the side frame according to FIG. 5I.

FIG. 5J shows an enlarged depiction of the rear lower corner region of side frame 10 according to FIG. 5I. This depiction shows the passage of threaded bolt 710 of rear foot 71 through bottom side strut 20 through the lower and upper profile segments (lower and upper wall sections of bottom strut 20) as well as the adjustability from above. Cover panels or support elements or the like that are placed onto bottom strut 20 are provided with openings in the axial direction of threaded bolt 710 so that the tool fitting of threaded bolt 710, e.g., an Allen socket, can be easily accessed from above. The drawing also shows fastener 513 in the form of the clamping screw for clamping the U-piece of vertical strut 40 against the end of bottom strut 20 oriented toward it, connecting bracket 90 to be mounted to vertical strut 40 and bottom strut 20 by means of fasteners 900, and securing support element 72 pivoted upward into the non-supporting position. Flange section 411 that is oriented inward parallel to the rear wall also constitutes a stable support for the upward oriented leg of stiffening bracket 90 and also for the edge of securing support element 72 lying parallel thereto.

Figure 6A:
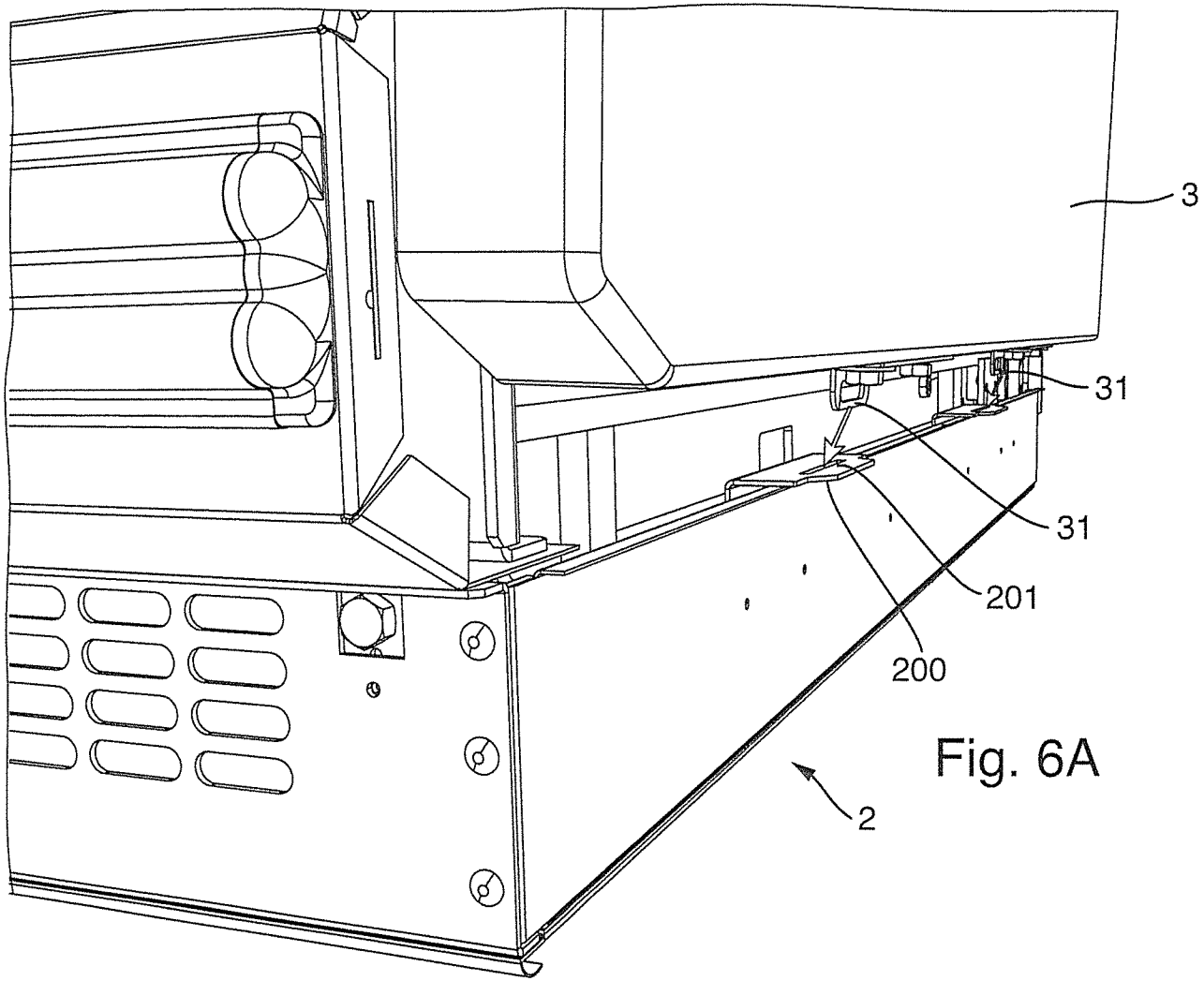
FIG. 6A is a perspective view of the detail of the refrigerated display case in a lower side region before insertion of the side wall.

FIGS. 6A through 6E show the positioning and fastening of side walls 3 in greater detail. On the side of the top side struts oriented toward the outside relative to refrigerated display case 1, as already shown in FIG. 5I, upper counterpart securing elements 500 are mounted, which have upward protruding tab-like securing legs provided with longitudinal slots, which in the example shown, are oriented vertically. In the lower side region of refrigerated display case 1, lower counterpart securing elements are mounted, as shown in FIG. 6A. Side wall 3 is mounted to upper counterpart securing elements 500 by means of upper securing elements and is secured to lower counterpart securing elements 200 by means of lower securing elements, as described below.

FIG. 6A shows the one lower side region of refrigerated display case 1 with respective side wall 3 that is to be mounted thereto. Lower securing elements 200 are embodied as angled, with one downward-oriented leg parallel to the side wall in the side pedestal region being mounted in a stable fashion directly to bottom side strut 20, e.g., to its outside, or indirectly via an intermediate element such as a laterally stable pedestal rail that is fastened to bottom side strut 20. The second leg of lower counterpart securing element 200 protrudes over the side pedestal rail at right angles to the lateral plane of refrigerated display case 1 and also at right angles to side wall 3 mounted thereon. In the laterally protruding leg of the lower counterpart securing element 200, an insertion opening 201 is provided, which in the exemplary embodiment shown is embodied as a longitudinal slot oriented parallel to the side wall.

At least two such counterpart securing elements 200 are mounted to the lower lateral edge region of refrigerated display case 1, spaced apart from each other and at an appropriate height, as shown in FIG. 6A. Lower securing elements 31 are mounted to respective side wall 3 in a position that is matched to the position of lower counterpart securing elements 200. In the exemplary embodiment shown, lower securing elements 31 are mounted to a lower edge that is oriented inward and extends at a right angle to the plane of side wall 3, which is why lower securing elements 31 are likewise embodied as angled and are provided with a downward-oriented leg parallel to the plane of side wall 3, which is matched to insertion opening 201 and can be inserted into it. With the upper angled leg, lower securing elements 31 are mounted, in particular screwed, to lower edge of the side wall 3 that is oriented inward and extends at a right angle. In accordance with the number of lower counterpart securing elements 200, side wall 3 is provided on its lower edge with a plurality of lower securing elements 31 that are matched in their position and dimensions to lower counterpart securing elements 200 and their insertion openings 201.

Figure 6B:
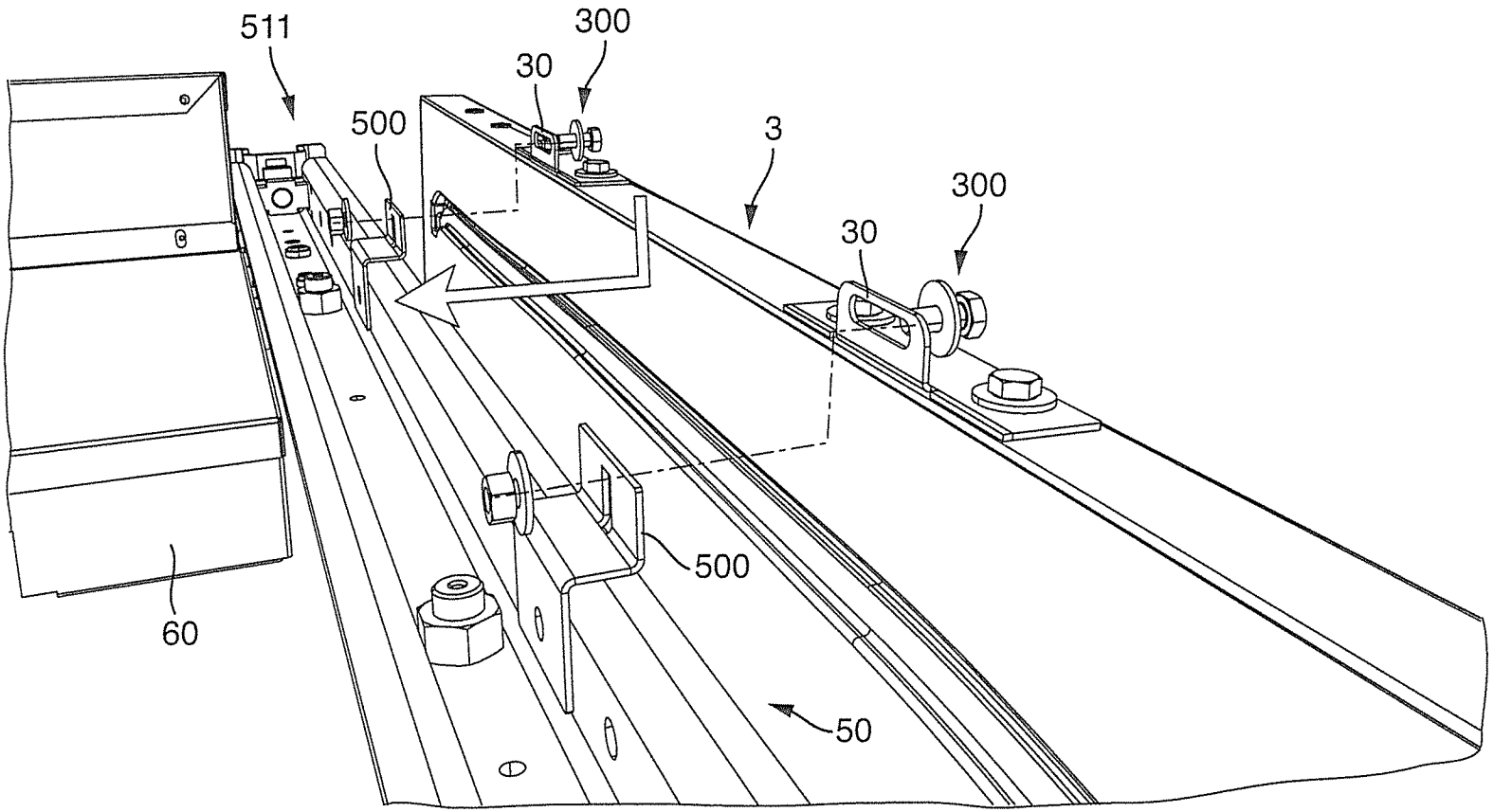
FIG. 6B is a perspective view of the detail of the refrigerated display case in its upper side region with a symbolic depiction of mounting steps.

In a first mounting step, side wall 3 is inserted with its lower securing elements 31 into insertion openings 201 from above and then is brought into contact along the lateral edges of rear wall assembly 4 and top assembly 5 that are oriented toward it, as symbolically depicted with an arrow in FIG. 6B.

As also shown in FIG. 6B, upper counterpart securing elements 500 are embodied as Z-shaped, with a lower leg oriented parallel to the side wall resting against the inside of the outer U-leg of top side strut 50 and the middle leg resting on the outward-oriented flange section of top side strut 50 and extending to its outer edge. In the exemplary embodiment shown, two upper counterpart securing elements 500 are situated spaced apart from each other along the length of top side strut 50 extending in the depth direction and are fastened for example by means of screws in the downward-oriented legs to the outer U-leg of top strut 50 by means of screws; it is also possible, however, to use other fasteners. The outer, upward-oriented legs of upper counterpart securing elements 500 are provided with the above-mentioned slot-shaped openings, which are oriented vertically in the exemplary embodiment shown.

Upper securing elements 30 that are matched in their positions and dimensions to upper counterpart securing elements 500 are mounted to respective side wall 3 and by means of them, side wall 3 is fastened to upper counterpart securing elements 500, for example, by means of securing screws 300 or other securing means. In the exemplary embodiment shown, upper securing elements 30 are mounted to an upper edge oriented inward toward the cooling chamber at right angles and have a rectangular shape in cross-section. A leg oriented perpendicular to the plane of side wall 3 in this case is brought into contact with the edge of side wall 3, which is oriented inward at right angles, and is fastened there by means of screws, for example.

An upward-oriented leg of upper securing element 30 parallel to the plane of side wall 3 in its position relative to mounted side wall 3 is aligned with the position of the associated upper counterpart securing element 500 and has an opening for a securing screw 300, which opening, in the exemplary embodiment shown, is embodied in the form of a horizontal slot-shaped opening, which is thus oriented at a right angle to the slot-shaped opening of upper counterpart securing element 500, thus enabling a horizontal and vertical adjustment of side wall 3. According to the number and position of upper counterpart securing elements 500, a plurality of upper securing elements 30 that are matched to the latter in their positions and dimensions are mounted to side wall 3, as shown in FIG. 6B.

Figure 6C:
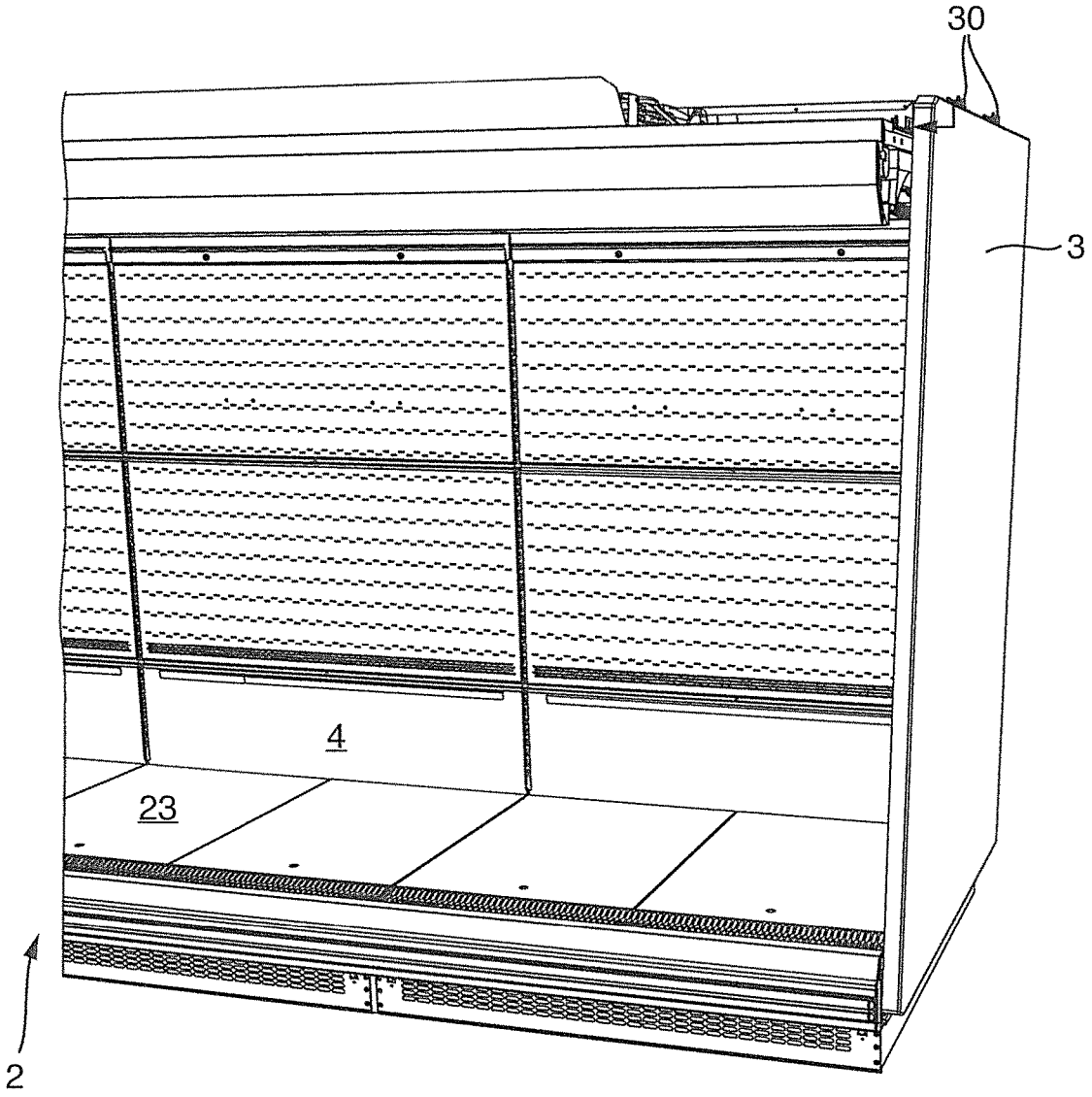
FIG. 6C is a perspective view of the detail of the refrigerated display case with a symbolic depiction of mounting steps for the side wall.
Figure 6D:
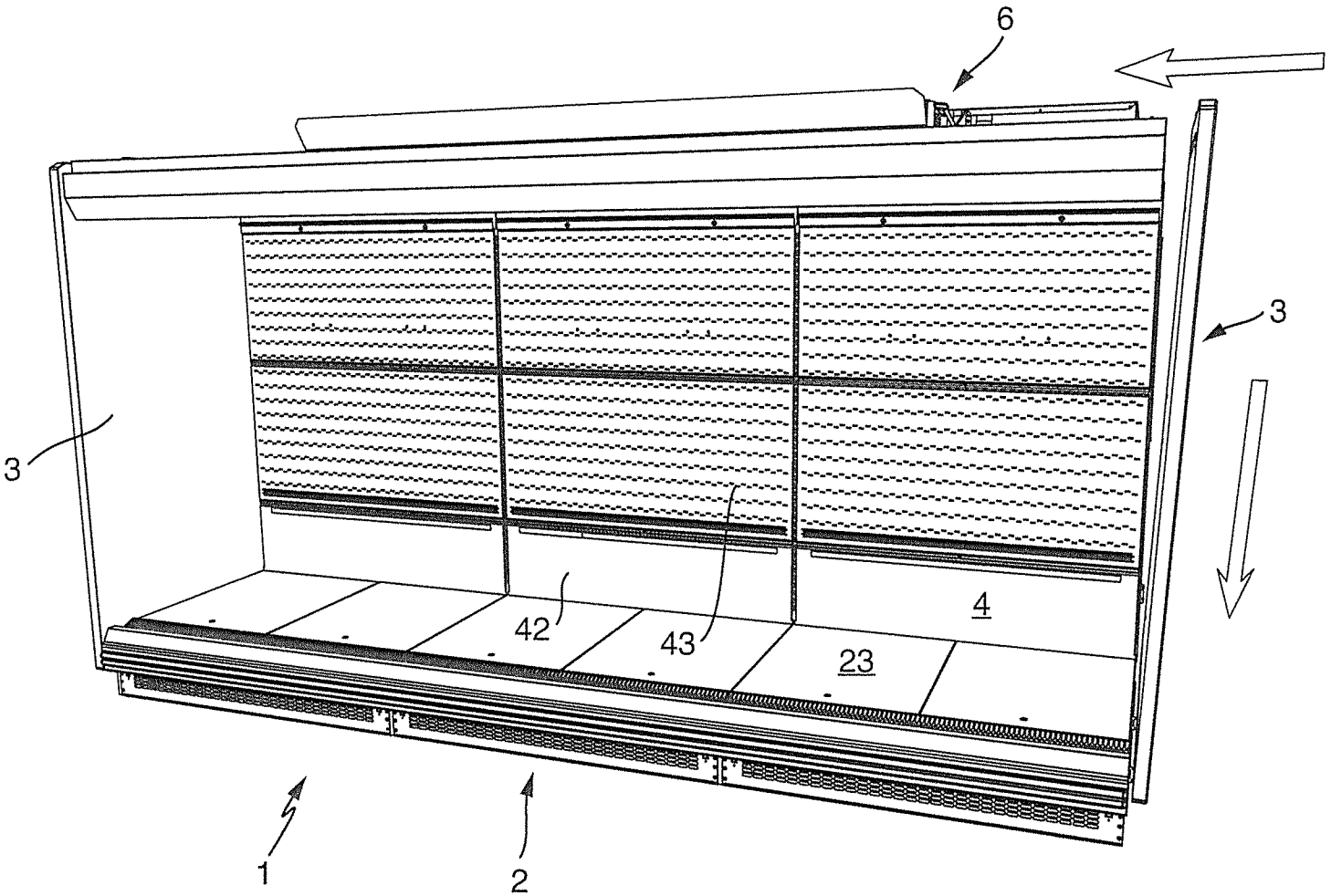
FIG. 6D is a perspective view of the refrigerated display case according to FIG. 1 with a symbolic depiction of mounting steps.
Figure 6E:
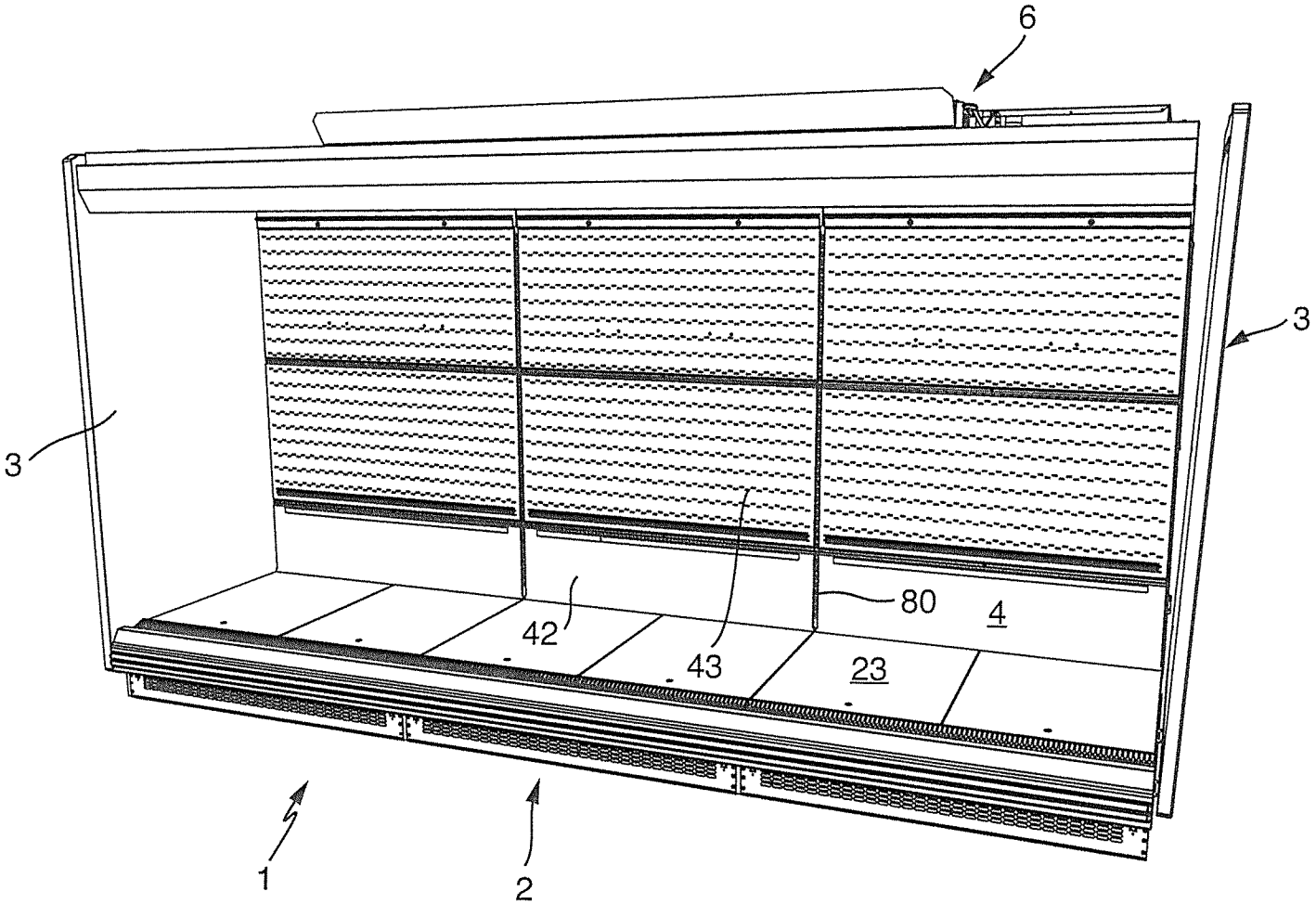
FIG. 6E is a perspective view of the refrigerated display case according to FIG. 1 with a first, partially mounted side wall.

FIGS. 6C, 6D, and 6E show the procedure of the mounting of side walls 3 of refrigerated display case 1. First, as shown in FIG. 6C, the side wall is inserted with its lower securing elements 31 into lower counterpart securing elements 200 and then in its upper region, is pivoted against the lateral edges of top assembly 5 and rear wall assembly 4 or more precisely against top strut 50 and vertical strut 40. Then upper securing elements 30 of side wall assembly 3 are secured to upper counterpart securing elements 500 by securing screws 300.

Refrigerated display case 1 is advantageously provided with a cooling device 6, which has an inclined plate heat exchanger situated on top, which is connected via a large lateral manifold to other cooling components in rear wall assembly 4. Another advantageous embodiment is comprised of a hybrid unit on the top of refrigerated display case 1. The hybrid unit has a plate heat exchanger with air cooling for dissipating heat to the surroundings of the display case if the room temperature is relatively low and also has a heat exchanger for connection to a central heat exchanger if the ambient temperature of refrigerated display case 1 or other requirements make it advisable to dissipate the heat into a room remote from refrigerated display case 1. The hybrid unit is embodied so that a controlled change-over by means of a control unit takes place, e.g., as a function of the ambient temperature of refrigerated display case 1. For the plate heat exchanger, a particular routing of air across the back side of the display case is provided in order to avoid a short circuit in the air flow.

Another advantageous embodiment relates to the positioning of the compressor of cooling device 6. The compressor housing for the compressor is adapted to the shape of the compressor; a shell-like envelope made of plastic with a lateral fastening flange and a lower end wall is provided. The compressor housing is positioned in the lower part of the rear wall, for example in the middle region relative to the width, and is mounted from the inside. In comparison to the mounting from the outside, this embodiment brings advantages with regard to air routing, thermal and sound insulation, and accessibility from the cooling chamber; the embodiment of the rear wall assembly with support struts 80 that are shifted forward, spaced apart from the rear offers advantages in this regard.

A wide variety of materials are available for the various parts discussed and illustrated herein. While the principles of this invention have been described in connection with specific embodiments, it should be understood clearly that these descriptions are made only by way of example and are not intended to limit the scope of the invention.

The invention claimed is:

1. A refrigerated display case comprising framework having two sides, each side including a C-shaped frame with a single-piece rear vertical side strut, a top side strut attached to a top end section of the vertical side strut, and a bottom side strut attached to a bottom end section of the vertical side strut; the C-shaped side frames are constructed separately and support cover panels of a bottom assembly, a rear wall assembly, and a top assembly, the cover panels being fastened by mounting elements and delimit a cooling chamber, the cooling chamber including at least one C-shaped intermediate frame between the C-shaped side frames, the at least one C-shaped intermediate frame is spaced laterally apart from the C-shaped side frames, the C-shaped intermediate frames each include a single-piece, vertical intermediate strut, a top intermediate strut, attached to a top end section of the vertical intermediate strut and a horizontal bottom intermediate strut attached to a bottom end section of the vertical intermediate strut, the at least one top intermediate strut and the top side strut having a hat-shaped cross-section and the top intermediate strut has a cavity which is open toward the bottom and the top side strut having a cavity which is open toward the top, the vertical side struts are clamped against a rear end face of the top side struts and bottom side struts and each vertical intermediate strut is clamped against a rear end face of the top intermediate strut and the bottom intermediate strut; the vertical side struts are clamped against the rear ends of the top side struts and bottom side struts with an intermediate piece, and the vertical intermediate struts are clamped against the rear ends of the top intermediate struts and bottom intermediate struts with an intermediate piece, and wherein in order to clamp the vertical side struts to the associated top side struts and the associated bottom side struts and in order to clamp the vertical intermediate struts to the associated top and bottom intermediate struts, fastening pieces are inserted into rear fastening sections of the top side struts and bottom side struts oriented toward the vertical side struts and into rear fastening sections of the top and bottom intermediate struts oriented toward the vertical intermediate struts, such fastening pieces having threaded bores and extend perpendicular to the longitudinal axes of the top and bottom struts, clamping screws are guided through the associated vertical side struts and associated vertical intermediate struts and are screwed into these threaded bores, the vertical intermediate struts include U-legs which are inserted between rearward protruding lateral fixing lugs which protrude rearward from U-legs of the bottom intermediate struts, a distance between the lateral fixing lugs is adapted to a distance between an outside of the U-legs of the vertical intermediate struts, the lateral fixing lugs and the U-legs of the vertical intermediate struts are provided with openings that are brought into alignment with each other and through which a securing screw is transversely guided to clamp the vertical intermediate strut to the bottom intermediate strut.

2. The refrigerated display case of claim 1 wherein the at least one vertical intermediate strut and the vertical side struts have a hat-shaped cross-section.

3. The refrigerated display case of claim 2 wherein the at least one bottom intermediate strut has a hat-shaped cross-section.

4. The refrigerated display case of claim 3 wherein the bottom side struts are embodied in the form of a closed hollow profile with a square or rectangular cross-section or alternatively have a C-shaped or hat-shaped cross-section.

5. The refrigerated display case of claim 4 wherein the vertical side struts are clamped against the rear ends of the top side struts and bottom side struts, and the vertical intermediate struts are clamped against the rear ends of the top intermediate struts and bottom intermediate struts.

6. The refrigerated display case of claim 1 wherein the vertical side struts and the associated bottom side struts are connected by means of a stiffening bracket.

7. The refrigerated display case of claim 6 wherein in the rear region of the two side frames, spaced apart from the vertical strut in the forward direction, a respective vertical support strut is installed between the bottom side strut and top side strut.

8. The refrigerated display case of claim 7 further including cover panels having thermally insulating plate-shaped elements that are fastened to an inside of the side frames and intermediate frames oriented toward the cooling chamber.

9. The refrigerated display case of claim 7 wherein the support struts are provided with rows of holes with a predetermined spacing pattern, in which support arms that protrude forward into the cooling chamber can be hung and the support struts made of metal are installed in a supporting fashion relative to the top side struts and bottom side struts likewise made of metal and relative to the bottom and top intermediate struts by means of thermally insulating intermediate pieces.

10. The refrigerated display case of claim 9 wherein vertically adjustable front and rear feet are fastened to the bottom side struts and bottom intermediate struts.

* * * * *